US006883253B2

(12) United States Patent
Smith et al.

(10) Patent No.: US 6,883,253 B2
(45) Date of Patent: Apr. 26, 2005

(54) 2A IMPROVEMENTS

(75) Inventors: Steven Smith, Lake Oswego, OR (US); Allen W. Van Noy, Portland, OR (US)

(73) Assignee: Fila Sport S.p.A., Biella (IT)

( * ) Notice: Subject to any disclaimer, the term of this patent is extended or adjusted under 35 U.S.C. 154(b) by 0 days.

(21) Appl. No.: 10/603,654

(22) Filed: Jun. 26, 2003

(65) Prior Publication Data

US 2004/0049947 A1 Mar. 18, 2004

Related U.S. Application Data

(63) Continuation of application No. 09/238,155, filed on Jan. 28, 1999, now abandoned.
(60) Provisional application No. 60/073,573, filed on Jan. 30, 1998.

(51) Int. Cl.[7] ..... A43B 13/18; A43B 13/20; A43B 19/00

(52) U.S. Cl. ..... 36/28; 36/29; 36/43; 36/35 R; 36/91; 36/71

(58) Field of Search ..... 36/43, 28, 29, 36/35 R, 35 B, 91, 92, 88, 37, 71, 153

(56) References Cited

U.S. PATENT DOCUMENTS

| | | | |
|---|---|---|---|
| 456,677 | A | 7/1891 | Mcintyre |
| 536,590 | A | 3/1895 | Tillgren |
| 558,345 | A | 4/1896 | Bowen |
| 1,514,468 | A | 11/1924 | Schopf |
| 1,605,588 | A | 11/1926 | Huiskamp |
| 2,080,469 | A | 5/1937 | Gilbert |
| 2,597,393 | A | 5/1952 | Slampa |
| 2,599,871 | A | 6/1952 | Slampa et al. |
| 4,219,945 | A | 9/1980 | Rudy |
| 4,262,433 | A | 4/1981 | Hagg et al. |
| D288,621 | S | 3/1987 | Surpuriya et al. |
| 4,670,995 | A | 6/1987 | Huang |
| 4,722,131 | A | 2/1988 | Huang |
| D297,381 | S | 8/1988 | Sugiyama |
| 4,768,295 | A | 9/1988 | Ito |
| D297,980 | S | 10/1988 | Sugiyama |
| 4,782,603 | A | 11/1988 | Brown |
| D300,084 | S | 3/1989 | Ito et al. |
| D300,085 | S | 3/1989 | Ito et al. |
| 4,817,304 | A | 4/1989 | Parker et al. |
| 4,845,861 | A | 7/1989 | Moumdjian |
| 4,864,737 | A | 9/1989 | Marrello |
| 4,914,836 | A | 4/1990 | Horovitz |
| D308,901 | S | 7/1990 | Hase |
| 4,999,931 | A | 3/1991 | Vermeulen |
| 5,067,255 | A | 11/1991 | Hutcheson |
| 5,092,060 | A | 3/1992 | Frachey et al. |
| 5,152,081 | A | 10/1992 | Hallenbeck et al. |
| 5,155,927 | A | 10/1992 | Bates et al. |
| 5,174,049 | A | 12/1992 | Flemming |
| 5,175,946 | A | 1/1993 | Tsai |
| D336,772 | S | 6/1993 | Forland et al. |
| 5,220,737 | A | 6/1993 | Edington |
| D340,349 | S | 10/1993 | Kilgore et al. |
| D340,350 | S | 10/1993 | Kilgore et al. |
| 5,255,451 | A | 10/1993 | Tong et al. |
| D343,504 | S | 1/1994 | Lee |

(Continued)

FOREIGN PATENT DOCUMENTS

| | | |
|---|---|---|
| AU | 650270 | 12/1991 |
| EP | 0 293 034 | 11/1988 |
| EP | 0 399 332 | 11/1990 |

*Primary Examiner*—Anthony Stashick
(74) *Attorney, Agent, or Firm*—Oblon, Spivak, McClelland, Maier & Neustadt, P.C.

(57) ABSTRACT

An article of footwear is disclosed which comprises a vamp, a lower support connected to the vamp and at least one insert mounted in the lower support and which includes an airtight casing having a plurality of elements positioned therein which are elastically deformable such that the biomechanics of the foot of the user are optimized.

63 Claims, 40 Drawing Sheets

U.S. PATENT DOCUMENTS

| | | | |
|---|---|---|---|
| D345,249 | S | 3/1994 | Sell, Jr. |
| D347,315 | S | 5/1994 | Sell, Jr. et al. |
| 5,313,717 | A | 5/1994 | Allen et al. |
| D349,186 | S | 8/1994 | Passke et al. |
| D349,804 | S | 8/1994 | Passke et al. |
| D351,056 | S | 10/1994 | Auger et al. |
| D351,277 | S | 10/1994 | Aveni et al. |
| 5,353,459 | A | 10/1994 | Potter et al. |
| 5,369,896 | A | 12/1994 | Frachey et al. |
| 5,384,977 | A | 1/1995 | Chee |
| D355,755 | S | 2/1995 | Kilgore |
| 5,406,719 | A | 4/1995 | Potter |
| 5,444,926 | A | 8/1995 | Allen et al. |
| D363,816 | S | 11/1995 | Sarkinen et al. |
| D364,034 | S | 11/1995 | Lee et al. |
| D364,035 | S | 11/1995 | Lee |
| D364,036 | S | 11/1995 | Passke et al. |
| D370,116 | S | 5/1996 | Passke et al. |
| D374,761 | S | 10/1996 | Sell, Jr. |
| 5,572,804 | A | 11/1996 | Skaja et al. |
| 5,575,088 | A | 11/1996 | Allen et al. |
| D376,897 | S | 12/1996 | Passke et al. |
| D376,898 | S | 12/1996 | Passke et al. |
| D376,899 | S | 12/1996 | Passke et al. |
| D376,900 | S | 12/1996 | Seydel et al. |
| D377,110 | S | 1/1997 | Passke et al. |
| D377,111 | S | 1/1997 | Passke et al. |
| D377,112 | S | 1/1997 | Passke et al. |
| D377,113 | S | 1/1997 | Passke et al. |
| D377,559 | S | 1/1997 | Passke et al. |
| 5,598,645 | A | 2/1997 | Kaiser |
| D378,629 | S | 4/1997 | Passke et al. |
| 5,617,650 | A | 4/1997 | Grim |
| 5,625,964 | A | 5/1997 | Lyden et al. |
| D380,290 | S | 7/1997 | Nakagawa |
| D385,393 | S | 10/1997 | Wong |
| D385,394 | S | 10/1997 | Passke et al. |
| D386,289 | S | 11/1997 | Passke et al. |
| D386,290 | S | 11/1997 | Passke et al. |
| D386,894 | S | 12/1997 | Passke et al. |
| D387,547 | S | 12/1997 | Seydel et al. |
| D391,750 | S | 3/1998 | Santos et al. |
| D391,751 | S | 3/1998 | Santos et al. |
| 5,755,001 | A | 5/1998 | Potter et al. |
| D394,948 | S | 6/1998 | Edington et al. |
| 5,765,298 | A | 6/1998 | Potter et al. |
| 5,771,606 | A | 6/1998 | Litchfield et al. |
| D395,744 | S | 7/1998 | Edington et al. |
| D396,341 | S | 7/1998 | Lozano et al. |
| D396,342 | S | 7/1998 | Foxen et al. |
| D396,343 | S | 7/1998 | Foxen et al. |
| 5,784,807 | A | 7/1998 | Pagel |
| D397,238 | S | 8/1998 | Lozano et al. |
| 5,787,609 | A | 8/1998 | Wu |
| 5,802,739 | A | 9/1998 | Potter et al. |
| 5,815,950 | A | 10/1998 | Wang |
| 5,832,630 | A | 11/1998 | Potter |

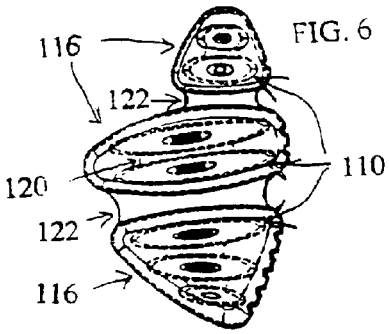
FIG. 6
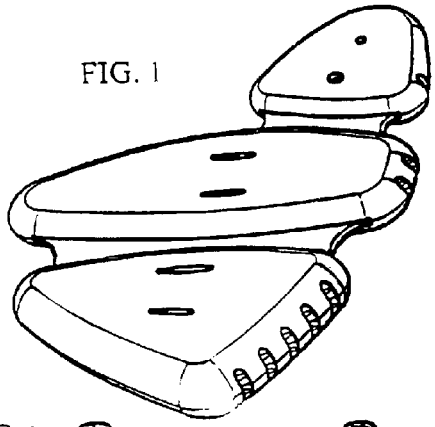
FIG. 1
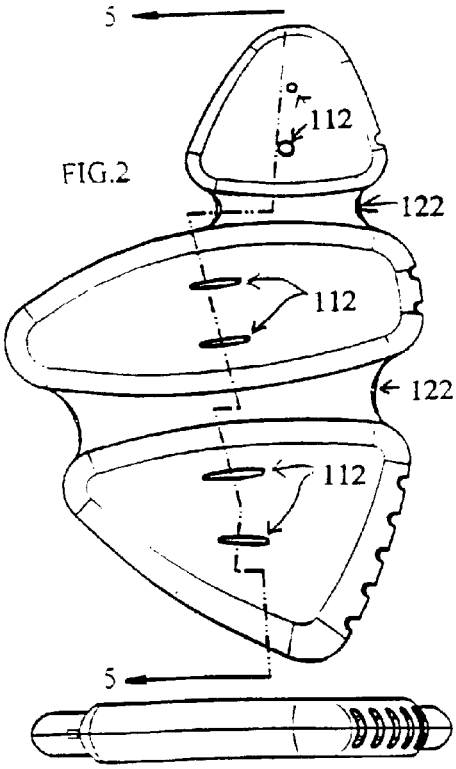
FIG.2
FIG.3
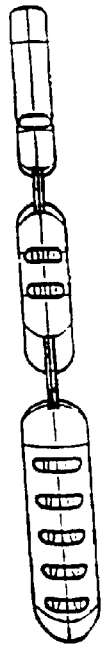
FIG.4
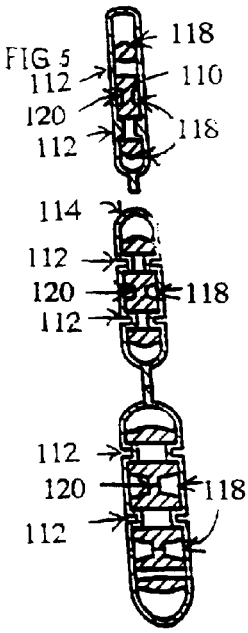
FIG.5

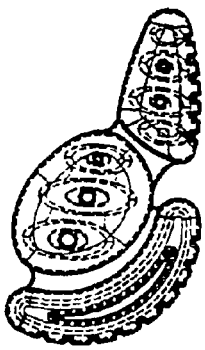
FIG.26
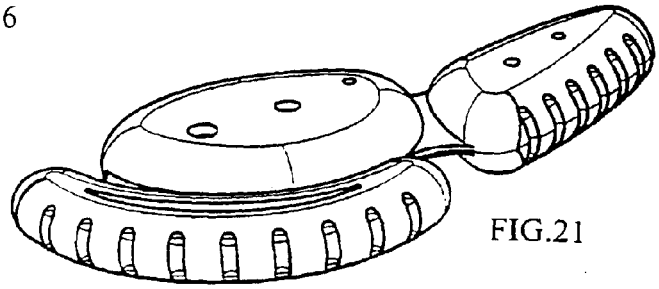
FIG.21
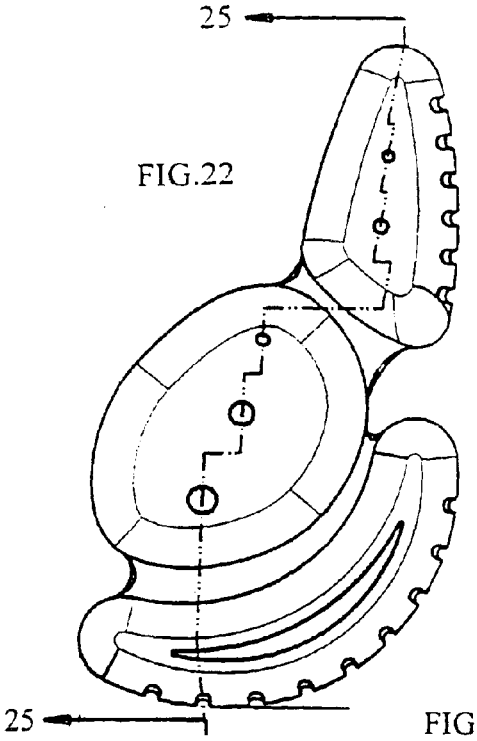
FIG.22
FIG.23
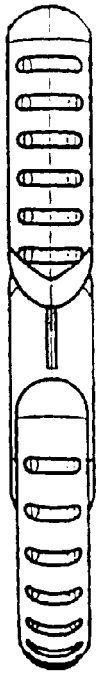
FIG.24
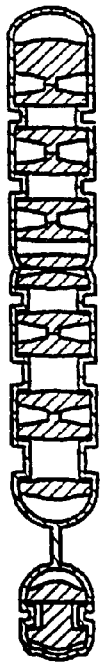
FIG.25

FIG.47
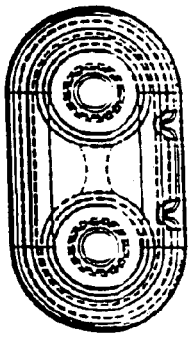
FIG.41
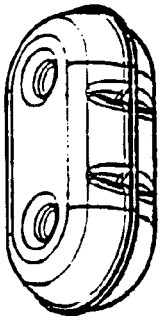
FIG.42
FIG.44
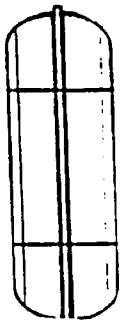
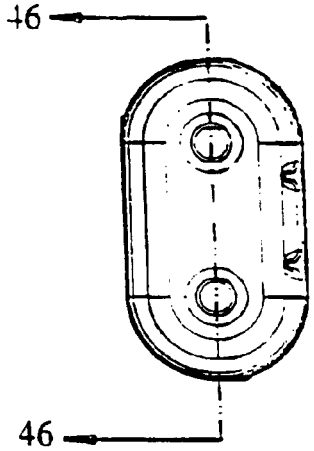
FIG.45
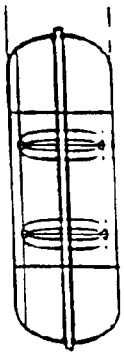
FIG.46
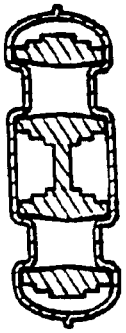
FIG.43
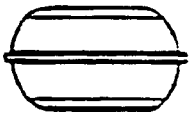

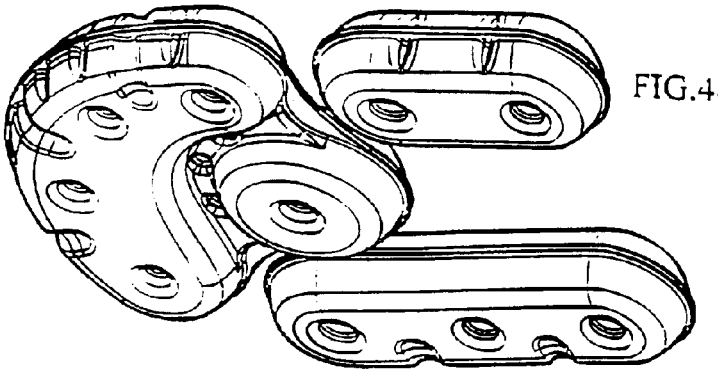
FIG.48
FIG.51
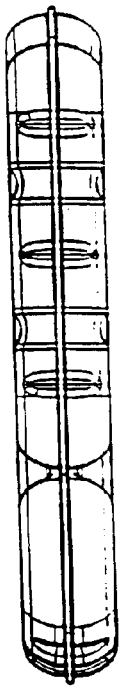
FIG.49
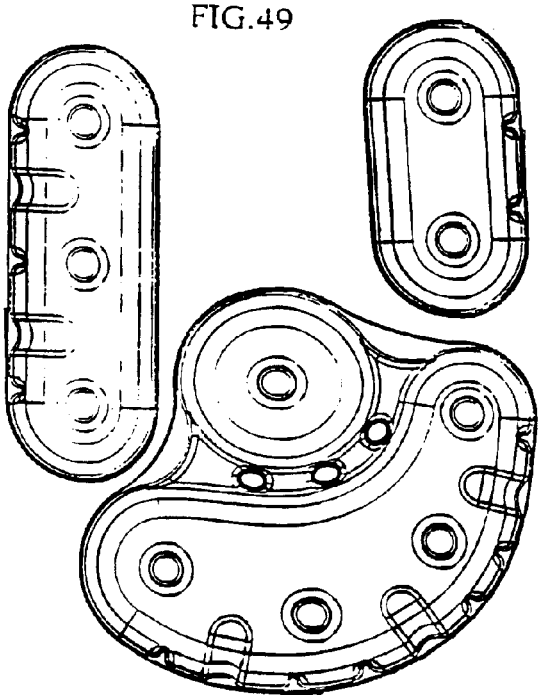
FIG.52
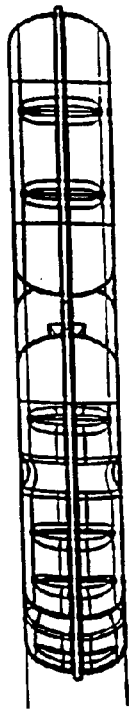
FIG.50
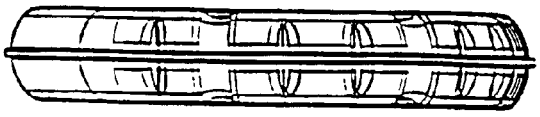

FIG.60
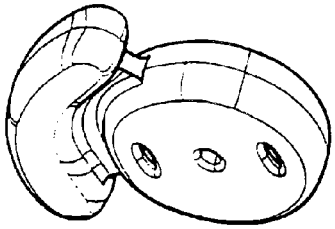
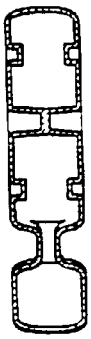
FIG.67
FIG.63
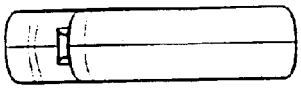
FIG.61
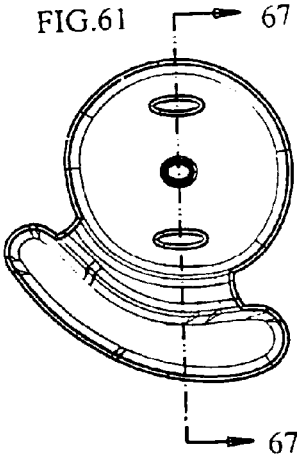
FIG.64
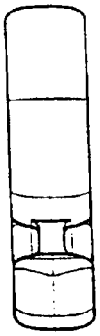
FIG.65
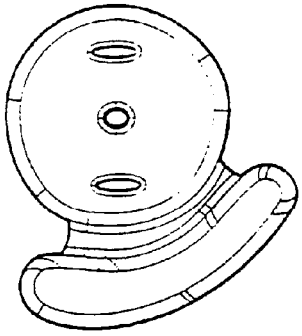
FIG.66
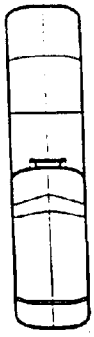
FIG.62
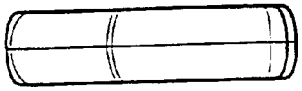

FIG.69
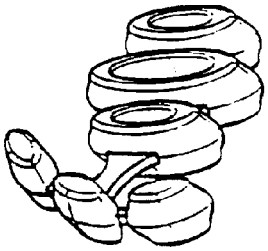
FIG.68
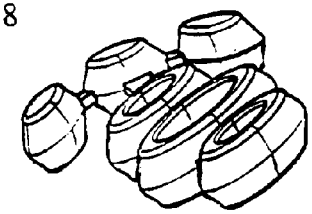
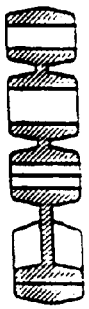
FIG.76
FIG.75
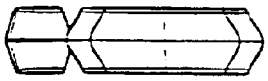
FIG.73
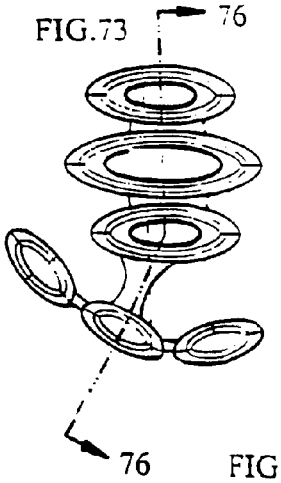
FIG.72
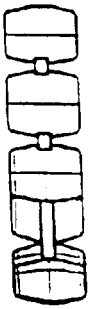
FIG.70
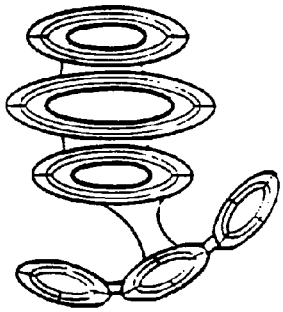
FIG.71
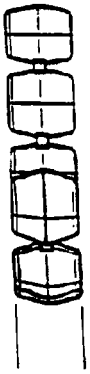
FIG.74
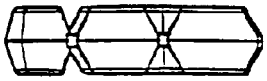

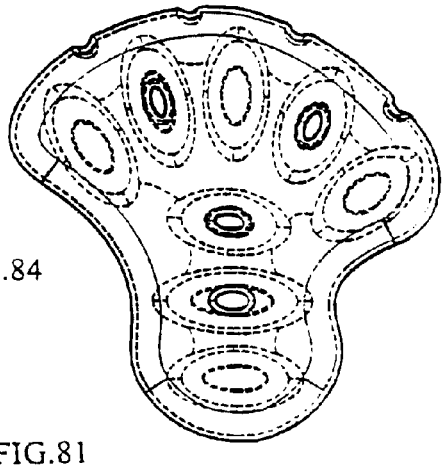
FIG.84
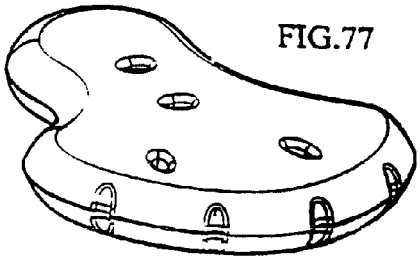
FIG.77
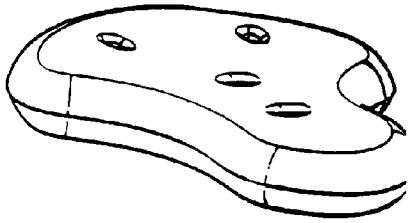
FIG.78
FIG.81
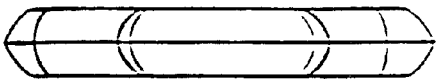
FIG.83
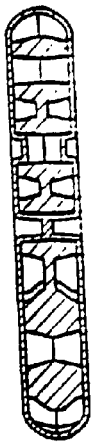
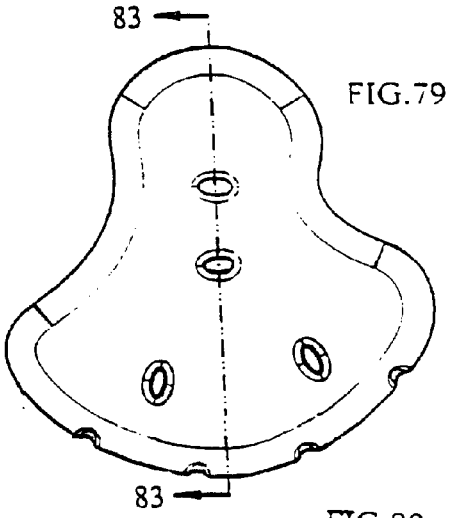
FIG.79
FIG.82
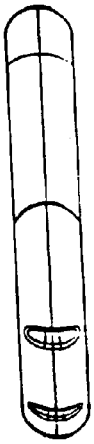
FIG.80
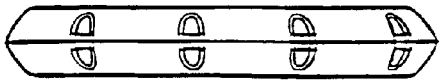

FIG.95
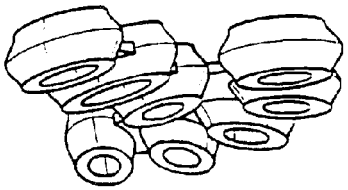
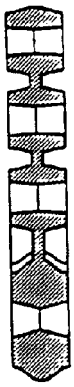
FIG.105
FIG.94
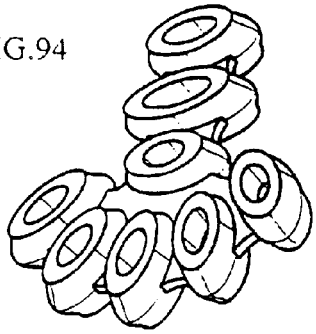
FIG.101
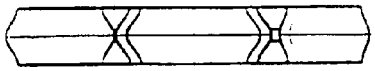
FIG.99
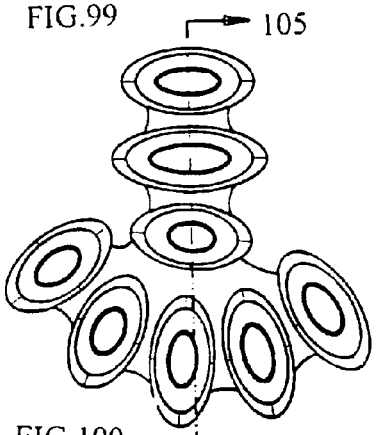
FIG.98
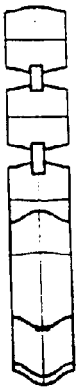
FIG.96
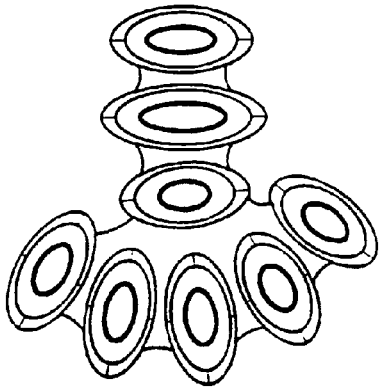
FIG.97
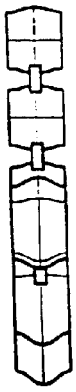
FIG.100
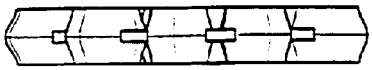

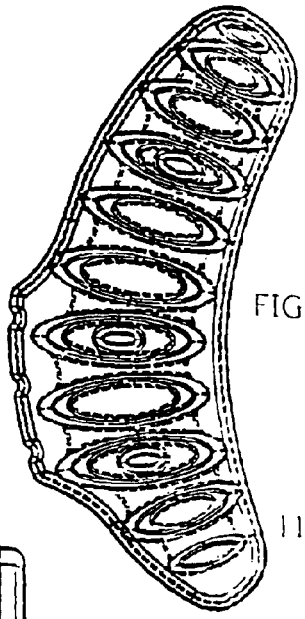
FIG.112
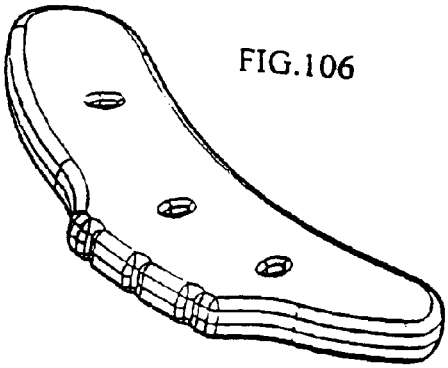
FIG.106
111 FIG.107
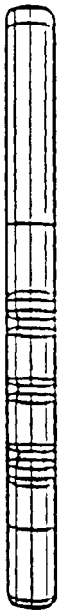
FIG.110
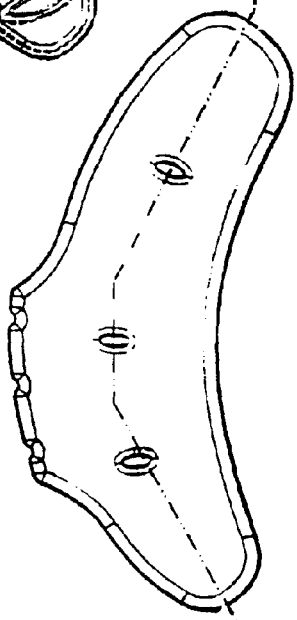
111
FIG.108
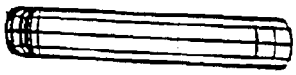
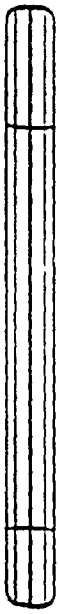
FIG.109
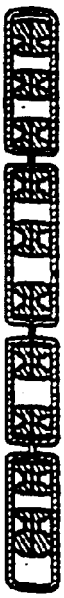
FIG.111

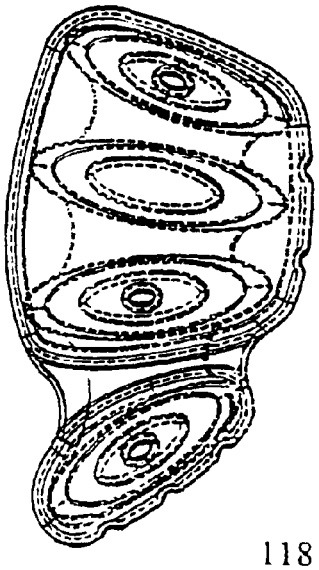
FIG.119
FIG.113
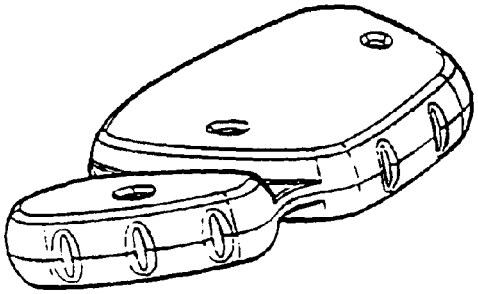
FIG.114
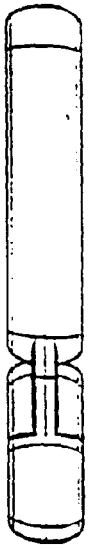
FIG.117
118
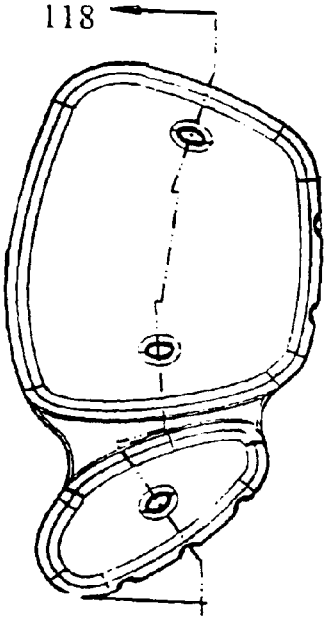
118
FIG.115
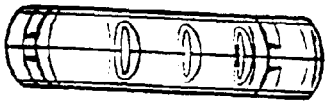
FIG.116
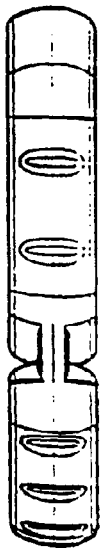
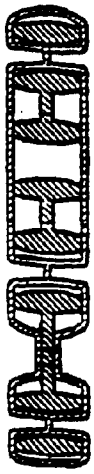
FIG.118

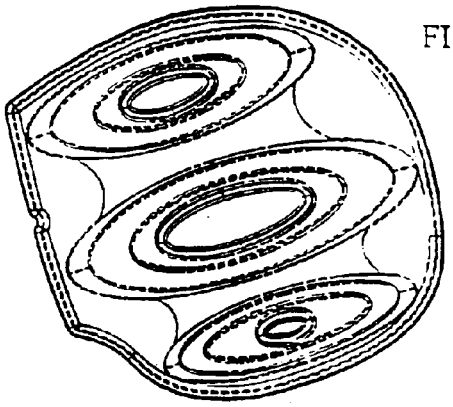
FIG.126
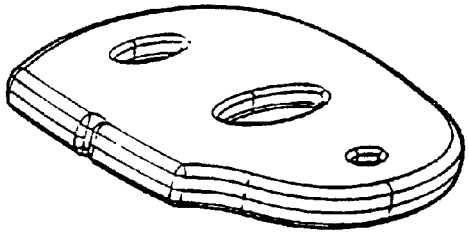
FIG.120
FIG.121
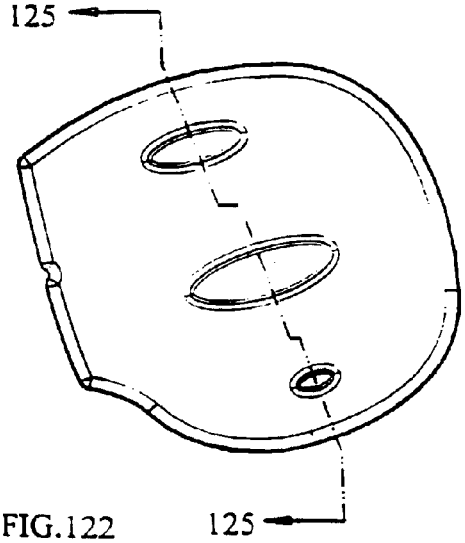
FIG.124
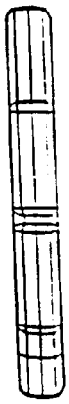
FIG.123
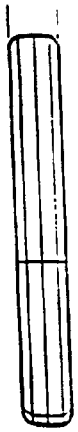
FIG.125
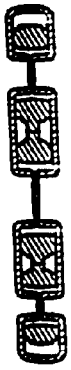
FIG.122
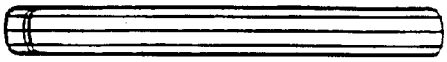

FIG.132
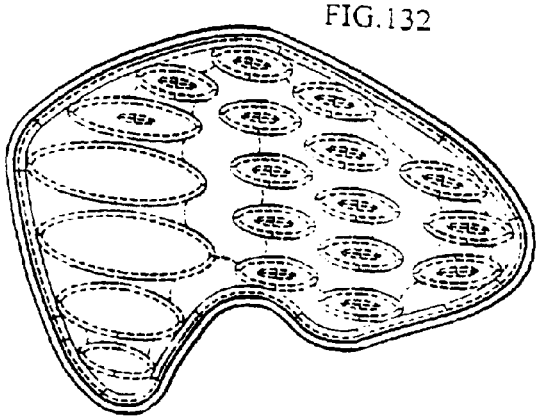
FIG.127
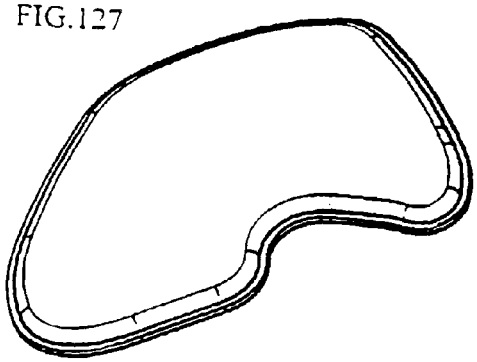
FIG.129
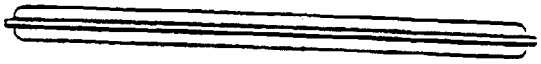
FIG.128
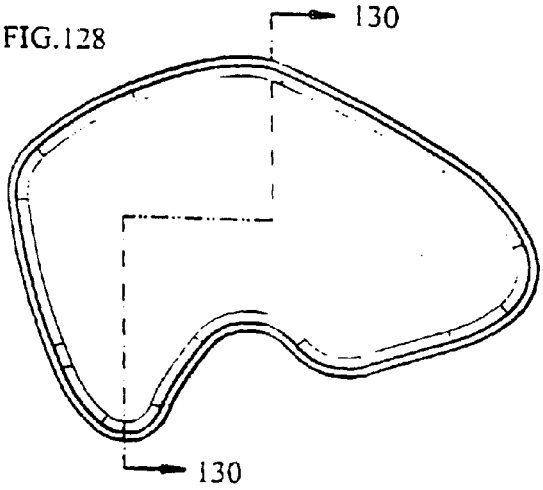
FIG.130
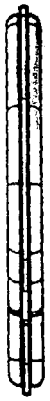
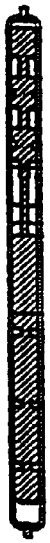
FIG.131

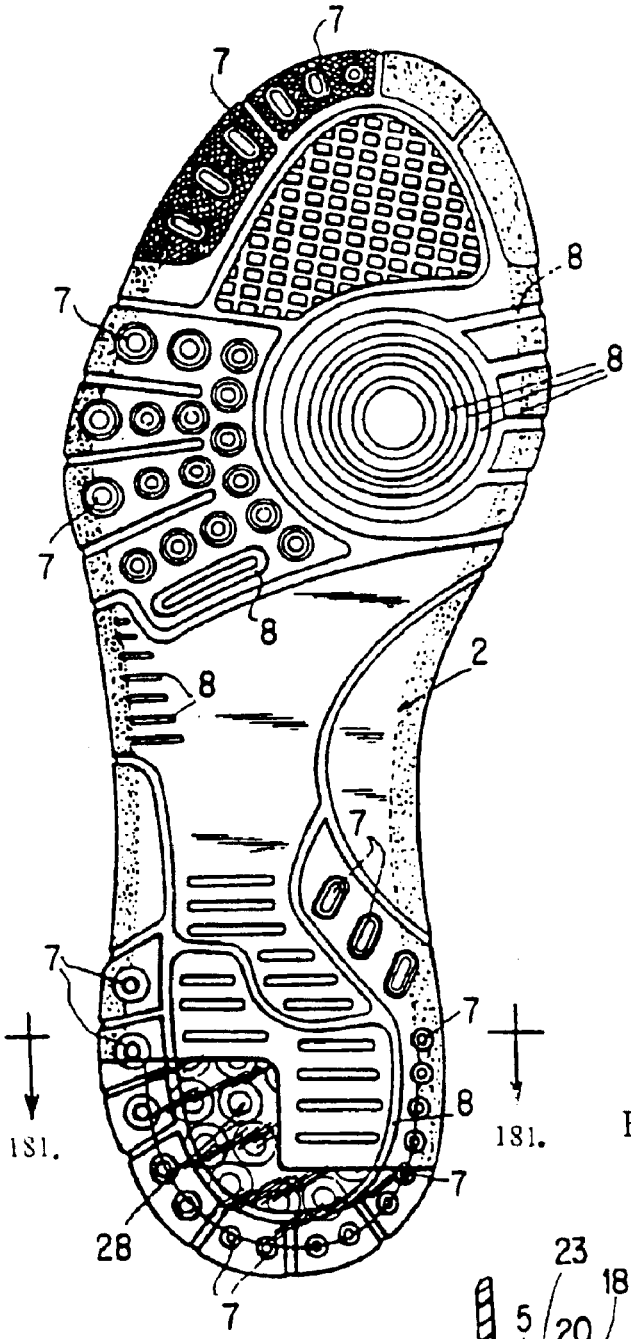
FIG. 180
FIG. 181
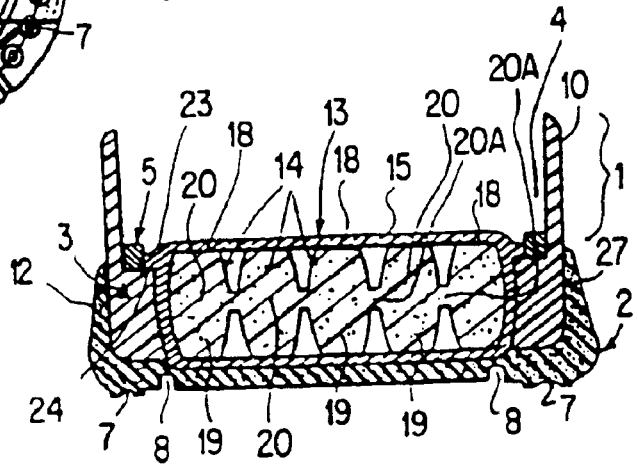

2A IMPROVEMENTS

This application is a continuation of application Ser. No. 09/238,155, filed Jan. 28, 1999. now abandoned which was based on U.S. provisional application Ser. No. 60/073,573, filed Jan. 30, 1998, the priority of which is hereby claimed.

BACKGROUND OF THE INVENTION

1. Field of the Invention

The present invention is directed to a method and apparatus corresponding to an insert for an article of footwear with improved elastically deformable elements and arrangements therefor which permit optimization of the biomechanics of a user's foot.

2. Discussion of the Background

Barrel shaped elastically deformable elements are taught in the U.S. Pat. No. 5,092,060 issued to Frachey et al and U.S. Pat. No. 5,396,896 issued to Frachey et al, the subject matter of which is hereby expressly incorporated by reference into this application and which is illustrated in FIGS. 179–182. Frachey et al '060 and '896 teach an article of footwear comprising a vamp A at a lower support part 1 which comprises a sole 2 a wedge 3, a mounting insole 5, and a further insole 6. Elastically deformable elements 14 of Frachey et al '060 contained inside an insert 13, are arranged in seat 16 formed in wedge 3. The deformable elements 14 are formed by molding a synthetic high elasticity material and are substantially barrel shaped, with their major cross-sections being substantially in the central region 20 in which said elements are joined together by an integral bridging portion 28. Deformable elements 14 are arranged in an insert 13 made of thermoplastic material enclosed in an airtight casing 15 which is constructed of plastic material such as polyurethane or similar material. The air inside casing 15 has a pressure of less than or equal to atmospheric pressure.

With reference to FIGS. 179–182 of the present application, the article of footwear of Frachey et al '060 comprises a vamp A and a lower support part 1 comprising a sole 2, for example of synthetic rubber, to which a wedge 3, for example of thermoplastic polyurethane, is fixed in a known manner. The wedge comprises a recess 4, bounded by a raised edge 10, carrying a mounting insole 5, for example a cork, on which there is positioned a further insole 6, for example of fabric (not shown in FIG. 181). The sole 2, constructed advantageously of rubber, comprises the usual notches 7 and incisions or recessed portions 8 in its lower surface. It also comprises a front raised edge 11, and a lateral edge 12 which extends along the entire remaining perimeter of the sole.

According to this conventional article of footwear, in the lower part of the article of footwear there is arranged an insert 13 comprising elastically deformable elements 14 made of thermoplastic material enclosed in an air-tight casing 15 constructed of plastic material such as polyurethane or a similar material. In casing 15 there is present air that has a pressure less than or equal to atmospheric pressure. In this example, the insert 13 is positioned in seats 16 and 17 provided in the wedge 3 and in the insole 5 respectively, said seats being superposed. Alternatively, seat 17 can be omitted with insert 13 located only in seat 16 of wedge 3, so that the insole 5 is superimposed and covers seat 16.

More specifically, the elements 14 of the insert 13 are formed by molding any synthetic high-elasticity material and are substantially barrel-shaped, i.e., they are tapered at their opposing free ends 18 and 19 and have their major cross-section substantially in the central region 20 in which said elements are joined together by an integral bridging portion 20A. The barrel shaped elements are barrel shaped in the sense that all vertical cross sections taken along the vertical axis thereof are barrel shaped. Due to manufacturing requirements of insert 13, free ends, 18, 19 of barrel-shaped elements 14 are fastened to casing 15. This is actually the preferred embodiment of insert 13, wherein in a first phase, elements 14 are obtained by means of molding; subsequently they are encased inside thermo-soldering plastic sheets which constitute casing 15; the elements 14 are encased by sheets when they are at a relatively high temperature so that a welding of free ends 18, 19 of elements 14 with the sheets occurs. The connection between casing 15 and the barrel-shaped elements has the advantage of anchoring said elements inside said casing, thereby preventing the casing and barrel-shaped elements from moving during use of the article of footwear according to the invention and so contributing together with the mutual connection of the barrel-shaped elements 14 to desirable multidirectional stability and flexibility of the resulting article of footwear. This affords greater stability for insert 13 within the article of footwear, and permits better performance of the function for which it is intended, which functions will be further defined below.

The shape of elements 14, as shown and described by way of example, allows considerable absorption of the stresses caused by the user's foot as he moves, and at the same time allows a large part of the absorbed energy to be retransmitted rapidly but gradually to the foot. In order to secure the insert 13 within the seats 16 and 17, the insole 6 comprises on that face 21, facing the insole 5, a projection 22 of a shape corresponding to said seats and arranged to cooperate with them and with the insert 13. In the alternative embodiment recited above, the projection 22 can be omitted. The casing 15 of insert 13 comprises a flange 23 which, when the insert 13 has been positioned in the lower part 1 of the article of footwear, rests on a step 24 provided between the insole 5 and an inner surface 25 of the wedge 3. In the alternative, where the hole or seat 17 is omitted, the flange 23 rests on the contour of the wedge seat 16.

Finally, the sole comprises a reinforcement element 28 positioned below the insert 13 or in other positions of the sole where other inserts may be located, said reinforcement element 28 being formed, for example, of plastic material e.g. of natural or synthetic rubber and being advantageously somewhat transparent. Element 28 may or may not be tinted. Reinforcing element 28 is of a wear and abrasion resistant material and is preferably located in the heel portion and in the metatarsal portion of the sole.

During the use of an article of footwear according to this conventional insert, each time the user presses the lower part 1 of the article of footwear with his foot, the insert 13 is pressed towards the sole 2. Specifically, the pressing action exerted by the foot depresses the elements 14 which deform and increases the pressure within the airtight casing 15 which is constricted by the surrounding wall portion of its seat. When the user's heel ceases its pressing action, the elements 14 return to their initial configuration, so as to transmit a large part of the energy acquired during the pressing action to the user's foot, which therefore receives a gradual thrust at his heel (or other part of the foot, e.g., the metatarsal one) separates from the ground. To said thrust, exerted on the user's foot by elements 14, there must be added the thrust exerted by the air which is present inside insert 13, thus air being under pressure due to the action by the user's foot. These combined thrusts help transfer to the user's foot part of the energy transmitted by the user to the ground during movement.

Elastic inserts like the one disclosed above can be located in the other regions of the support part 1, in particular in proximity to the frontal region of the sole 2 and the wedge 3 and more particularly in the metatarsal zone 3A as shown in dotted lines in FIG. 179, where the seat is referenced by 16A and the insert by 13A, thus allowing the user (particularly an athlete) to obtain increased pickup during acceleration or during changes in the rate of movement.

The insert 13 shown in FIG. 179 and 181 comprises only one layer of elements 14; however, there can be provided an insert 13 having two or more layers of elements 14 superimposed as shown in FIG. 182. In particular, if the above cited insert has two layers of elements 14, a first layer supports the second whose deformable elements rest on the elements positioned below.

This conventional insert permits an improvement in the return of par of the energy (passed on by the user to the ground) to the foot of the user. It must be noted that, in the same manner previously described, free ends 18, 19 of barrel-shaped element 14, are fastened to (or soldered on) casing 15, whereas the contact surfaces of the two layers of element 14, if used, would be fastened to (or soldered on) each other. This affords stability for insert 13, preventing one of the layers from sliding over the other one within casing 15. An article of footwear constructed in accordance with the invention satisfies the aforesaid requirements and in particular enables most of the energy expended during movement to be retransferred to the foot.

SUMMARY OF THE INVENTION

The present invention has as the object thereof the provision of a method and apparatus which permits an article of footwear to have improved elastically deformable elements and arrangements therefore. The elements serve to optimize the biomechanics of the user's foot when wearing the article of footwear wherein the use of deformable elements which make it possible to provide for a more continuous contact therewith by the user's foot and therefore more evenly distribute energy transferred between the user's foot and the elements while maintaining the flexibility necessary in the article of footwear sole.

A further object of the present invention is to utilize deformable elements connected by bridging portions such that, when constructed as deformable batteries, for example, such can more easily bend along the bridging portion. Accordingly, one aspect of the present invention is to align the deformable elements such that the bridging portions are aligned with flex lines of the foot so as to thereby better follow and maintain contact with the sole of a user's foot. A further advantage of the present invention is that the casing or encapsulating bag is formed by a vacuum forming or blow molding which thereby lowers the cost of manufacturing and makes the same easier to accomplish. A further object of the present invention is to provide an arrangement whereby the stiffness and viscoelastic properties of the deformable elements are varied throughout positions in the sole in order to match the biomechanics of the user's foot, and preferably, according to the particular athletic activity of the user.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1 is a top, front and left side perspective view of a SOLE INSERT embodying a first embodiment of the present invention;

FIG. 2 is a top plan view thereof, the bottom view being a mirror image of the top view shown:

FIG. 3 is a front elevational view thereof;

FIG. 4 is a right side elevational view thereof;

FIG. 5 is a cross-sectional view thereof taken along line 5—5 of FIG. 2;

FIG. 6 is a top plan view thereof showing the pillars in phantom lines;

FIG. 21 is a top, front and left side perspective view of a fourth embodiment of the present invention;

FIG. 22 is a top plan view thereof. the bottom view being a mirror image of the top plan view shown;

FIG. 23 is a front elevational view thereof;

FIG. 24 is a right side elevational view thereof;

FIG. 25 is a cross-sectional view thereof taken along line 25—25 of FIG. 22;

FIG. 26 is a top plan view thereof showing the pillars of the insert in phantom lines;

FIG. 41 is a top of a front and right side perspective view thereof;

FIG. 42 is a top plan view thereof, the bottom plan view thereof being a mirror image of the top plan view shown;

FIG. 43 is a front elevational view thereof;

FIG. 44 is a left side elevational view thereof;

FIG. 45 is a right side elevational view thereof;

FIG. 46 is a cross-sectional view thereof taken along line 46—46 of FIG. 42;

FIG. 47 is a top plan view thereof showing the pillars of the insert in phantom lines;

FIG. 48 is a bottom, rear and right side elevational view of another embodiment of the present invention;

FIG. 49 is a top plan view thereof, the bottom plan view being a mirror image of the top plan view shown;

FIG. 50 is a front elevational view thereof;

FIG. 51 is a left side elevational view thereof;

FIG. 52 is a right side elevational view thereof;

FIG. 60 is a bottom, right side and rear perspective view of another embodiment of the present invention;

FIG. 61 is a top plan view thereof;

FIG. 62 is a front elevational view thereof;

FIG. 63 is a rear elevational view thereof;

FIG. 64 is a right side elevational view thereof;

FIG. 65 is a bottom plan view thereof;

FIG. 66 is left side elevational view thereof;

FIG. 67 is a cross-sectional view thereof taken along line 67—67 of FIG. 61;

FIG. 68 is a rear, bottom and left side perspective view thereof;

FIG. 69 is a top, front and right side perspective view thereof;

FIG. 70 is a top plan view thereof;

FIG. 71 is a right side elevational view thereof;

FIG. 72 is a left side elevational view thereof;

FIG. 73 is a bottom plan view thereof;

FIG. 74 is a front elevational view thereof;

FIG. 75 is a rear elevational view thereof;

FIG. 76 is a cross-sectional view taken along line 76—76 of FIG. 73;

FIG. 77 is a top, front and left side perspective view of another embodiment of the present invention;

FIG. 78 is a top, rear and left side perspective thereof;

FIG. 79 is a top plan view thereof, the bottom plan view being a mirror image of the top plan view shown;

FIG. 80 is a front elevational view thereof;

FIG. 81 is a rear elevational view thereof;

FIG. 82 is a right side elevational view thereof;

FIG. 83 is a cross-sectional view thereof taken along line 83—83 of FIG. 79;

FIG. 84 is a bottom plan view thereof showing the pillars of the insert in phantom lines;

FIG. 94 is a top, front and right side elevational view of another embodiment of the present invention;

FIG. 95 is a rear, bottom and left side perspective view thereof;

FIG. 96 is a top plan view thereof; the bottom plan view being a mirror image of the top plan view shown;

FIG. 97 is a right side elevational view thereof;

FIG. 98 is a left side elevational view thereof;

FIG. 99 is a bottom plan view thereof;

FIG. 100 is a front elevational view thereof;

FIG. 101 is a rear elevational view thereof;

FIG. 105 is a cross-sectional view thereof taken along line 105—105 of FIG. 100;

FIG. 106 is a top, front and left side view of another embodiment of the present invention;

FIG. 107 is a top plan view thereof, the bottom plan view being a mirror image of the top plan view shown;

FIG. 108 is a front elevational view thereof;

FIG. 109 is a right side elevational view thereof;

FIG. 110 is a left side elevational view thereof;

FIG. 111 is a cross-sectional view taken along line 111—111 of FIG. 107;

FIG. 112 is a top plan view thereof showing the pillars of the insert in phantom lines;

FIG. 113 is a top, front and right side perspective view of another embodiment of the present invention;

FIG. 114 is a top plan view thereof, the bottom view being a mirror image of the top plan view shown;

FIG. 115 is a front elevational view thereof;

FIG. 116 is a right side elevational view thereof;

FIG. 117 is a left side elevational view thereof;

FIG. 118 is a cross-sectional view thereof taken along line 118—118 of FIG. 114;

FIG. 119 is a top plan view thereof showing the pillars of the insert in phantom lines;

FIG. 120 is a top, front and right side perspective view of another embodiment of the present invention;

FIG. 121 is a top plan view thereof, the bottom plan view being a mirror image of the top plan view shown;

FIG. 122 is a front elevational view thereof;

FIG. 123 is a right side elevational view thereof;

FIG. 124 is a left side elevational view thereof;

FIG. 125 is a cross-sectional view thereof taken along line 125—125 of FIG. 121;

FIG. 126 is a top plan view thereof showing the pillars of the insert in phantom lines;

FIG. 127 is a top, front and right side perspective view of another embodiment of the present invention;

FIG. 128 is a top plan view thereof, the bottom plan view being a mirror image of the top plan view as shown;

FIG. 129 is a rear elevational view thereof;

FIG. 130 is a right side elevational view thereof;

Figure 13:
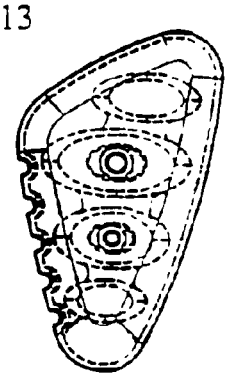
FIG. 13 is a top plan view thereof showing the pillars of the insert in phantom lines.
Figure 7:
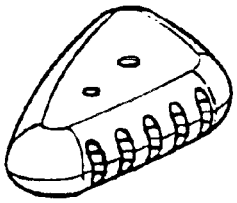
FIG. 7 is a top, front and left side perspective view of a second embodiment thereof.
Figure 8:
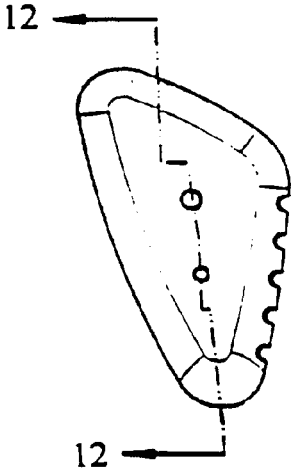
FIG. 8 is a top plan view thereof, the bottom view being a mirror image of the top view shown.
Figure 10:
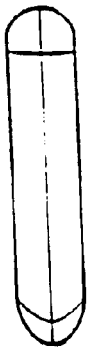
FIG. 10 is a left side elevational view thereof.
Figure 11:
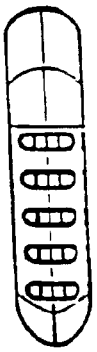
FIG. 11 is a right side elevational view thereof.
Figure 12:
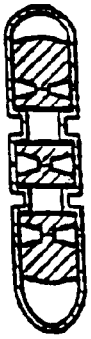
FIG. 12 is a cross-sectional view thereof taken along line 12—12 of FIG. 8.
Figure 9:
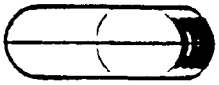
FIG. 9 is a front elevational view thereof.
Figure 20:
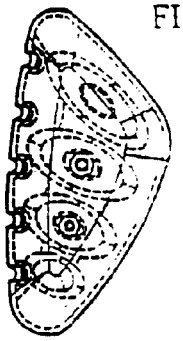
FIG. 20 is a top plan view thereof showing the pillars of the insert in phantom lines.
Figure 14:
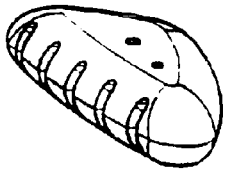
FIG. 14 is a top, front and left side perspective view of a third embodiment of the present invention.
Figure 15:
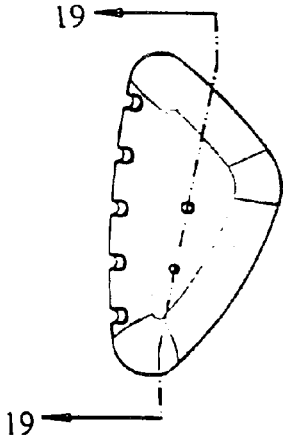
FIG. 15 is a top plan view thereof, the bottom view being a mirror image of the top view shown.
Figure 17:
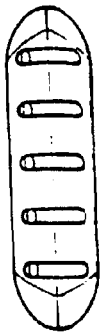
FIG. 17 is a left side elevational view thereof.
Figure 18:
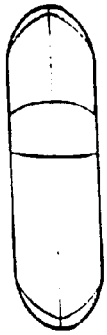
FIG. 18 is a right side elevational view thereof.
Figure 19:
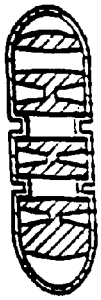
FIG. 19 is a cross-sectional view thereof taken along line 19—19 of FIG. 15.
Figure 16:
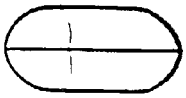
FIG. 16 is a front elevational view thereof.
Figure 33:
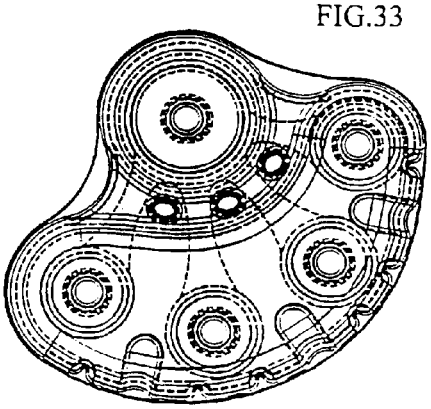
FIG. 33 is a top plan view thereof showing the pillars of the insert in phantom lines.
Figure 27:
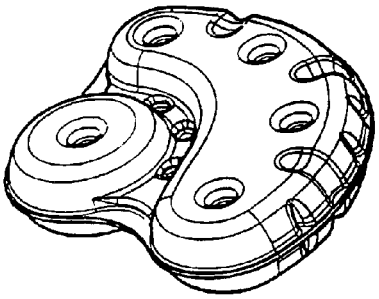
FIG. 27 is a top, front and left side perspective view of a fifth embodiment thereof.
Figure 30:
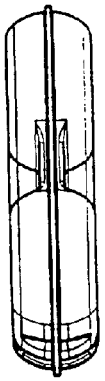
FIG. 30 is a left side elevational view thereof.
Figure 28:
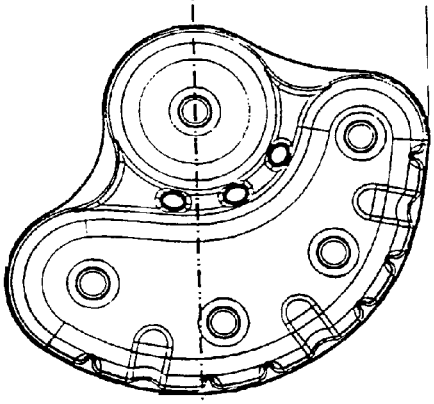
FIG. 28 is a top plan view thereof, the bottom plan view being a mirror image of the top plan view shown.
Figure 31:
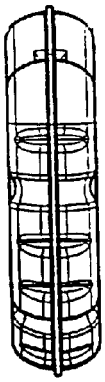
FIG. 31 is a right side elevational view thereof.
Figure 32:
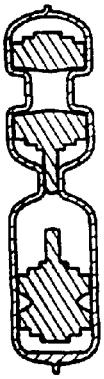
FIG. 32 is a cross-sectional view thereof taken along line 32—32 of FIG. 28.
Figure 29:
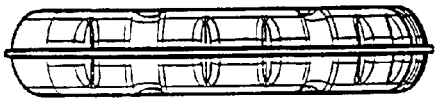
FIG. 29 is a front elevational view thereof.
Figure 40:
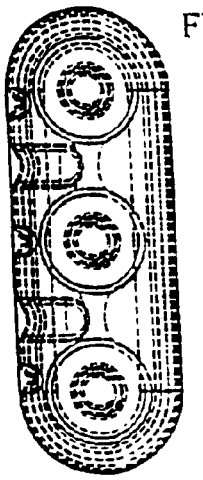
FIG. 40 is a top plan view hereof showing the pillars of the insert in phantom lines.
Figure 34:
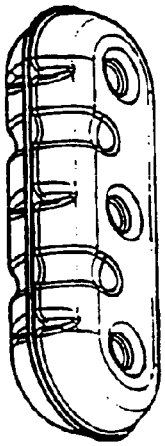
FIG. 34 is a top, front and left side perspective view of another embodiment of the present invention.
Figure 37:
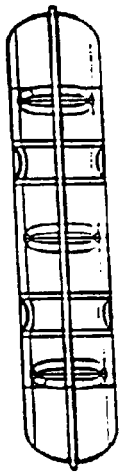
FIG. 37 is a left side elevational view thereof.
Figure 35:
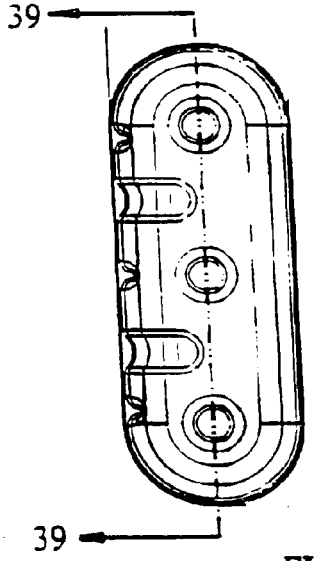
FIG. 35 is a top plan view thereof, the bottom plan view being a mirror image of the top plan view shown.
Figure 38:
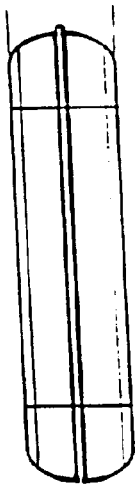
FIG. 38 is a right side elevational view thereof.
Figure 39:
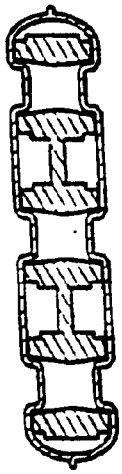
FIG. 39 is a cross-sectional view thereof taken along line 39—39 of FIG. 35.
Figure 36:
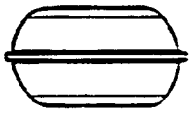
FIG. 36 is a front elevational view thereof.
Figure 53:
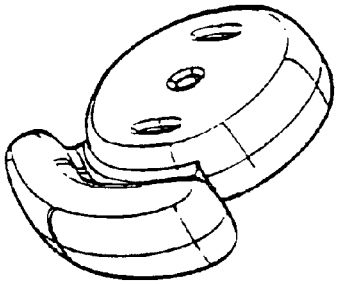
FIG. 53 is a top, front and right side perspective view of another embodiment of the present invention.
Figure 59:
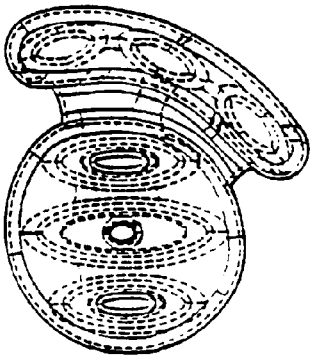
FIG. 59 is a top plan view thereof showing the pillars of the insert in phantom lines.
Figure 54:
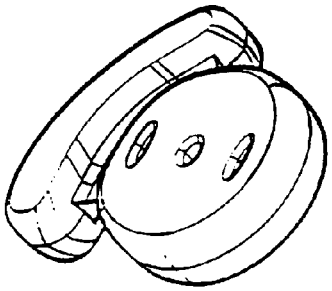
FIG. 54 is a rear, top and left side perspective view thereof.
Figure 56:
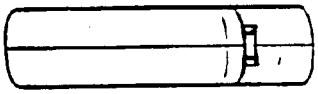
FIG. 56 is a rear elevational view thereof.
Figure 55:
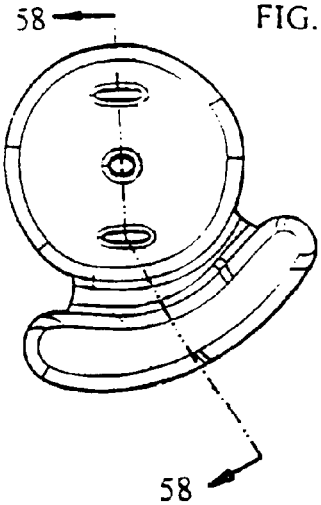
FIG. 55 is a top plan view thereof, the bottom view being a mirror image of the top plan view shown.
Figure 57:
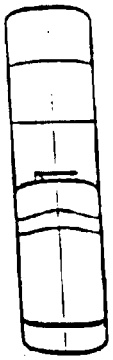
FIG. 57 is a right side elevational view thereof.
Figure 58:
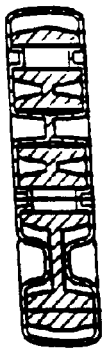
FIG. 58 is a cross-sectional view thereof taken along line 58—58 of FIG. 55.
Figure 86:
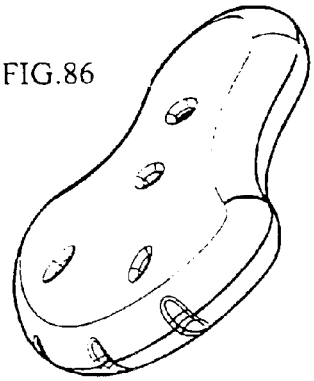
FIG. 86 is a top, front and right side elevational view thereof.
Figure 93:
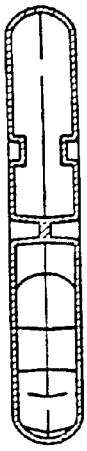
FIG. 93 is a cross-sectional view thereof taken along line 93—93 of FIG. 90.
Figure 85:
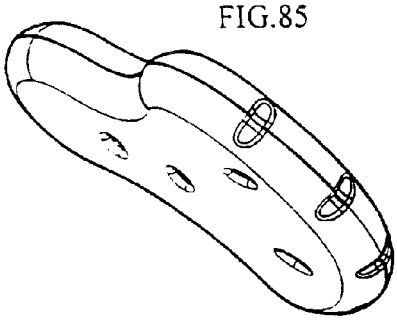
FIG. 85 is a bottom, front and left side perspective view of another embodiment of the present invention.
Figure 92:
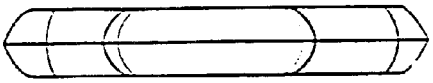
FIG. 92 is a rear elevational view thereof.
Figure 90:
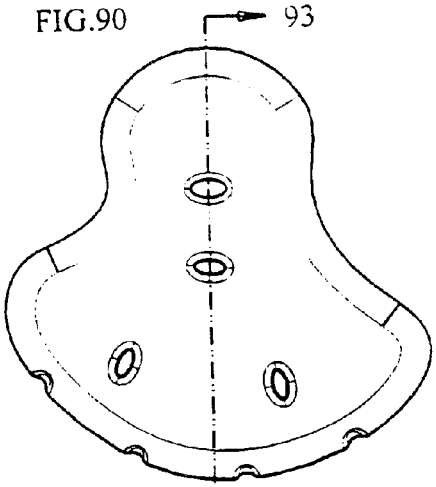
FIG. 90 is a bottom plan view thereof.
Figure 89:
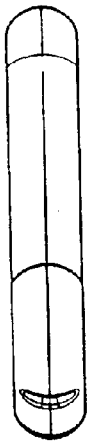
FIG. 89 is a left side elevational view thereof.
Figure 87:
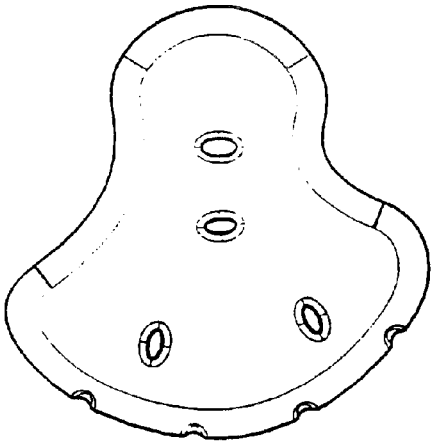
FIG. 87 is a top plan view thereof.
Figure 88:
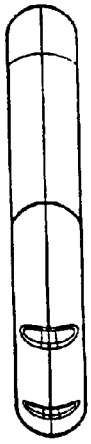
FIG. 88 is a right side elevational view thereof.
Figure 91:
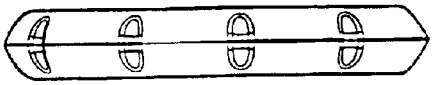
FIG. 91 is a front elevational view thereof.
Figure 102:
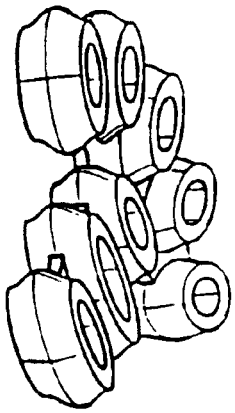
FIG. 102 is a rear, bottom and right side perspective view thereof.
Figure 103:
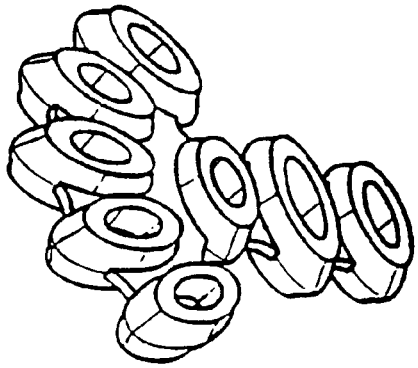
FIG. 103 is a rear, bottom and front side perspective thereof.
Figure 104:
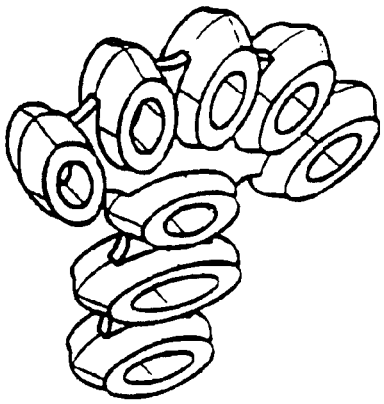
FIG. 104 is a rear and bottom side perspective view thereof.
Figure 133:
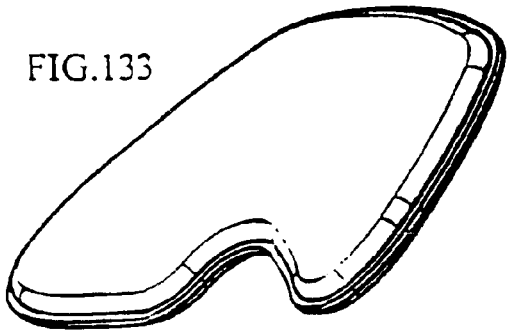
Figure 136:
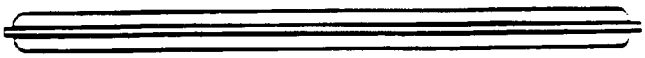
Figure 134:
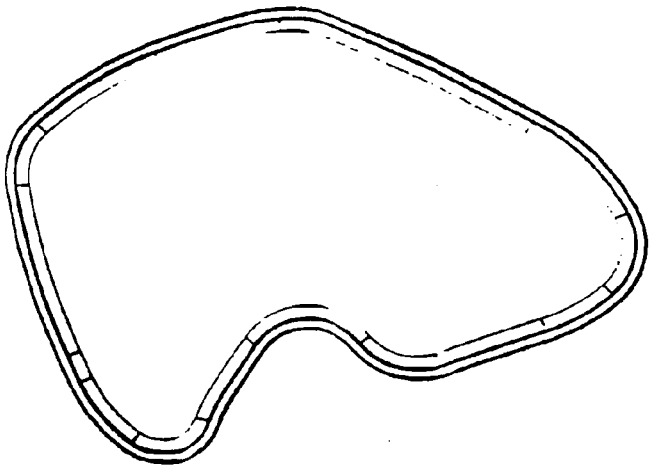
Figure 135:
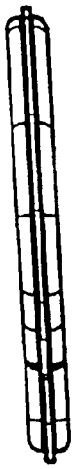
Figure 137:
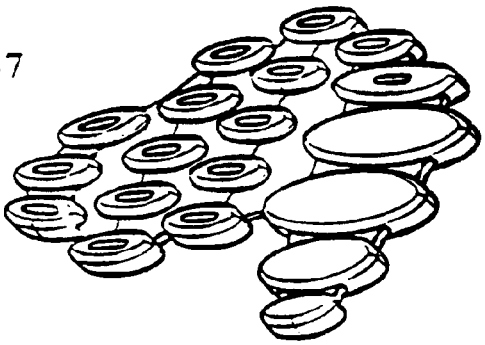
Figure 140:
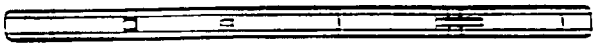
Figure 138:
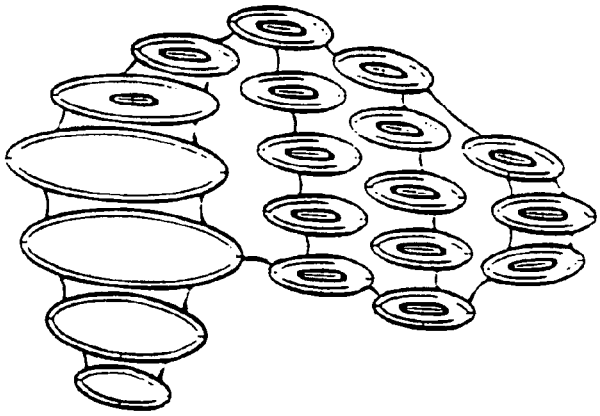
Figure 139:
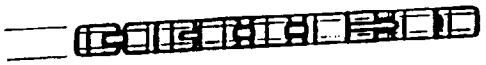
Figure 146:
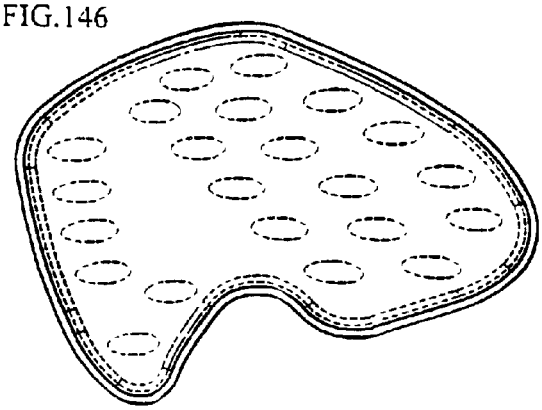
Figure 141:
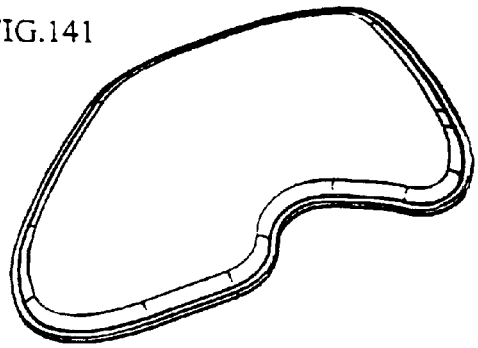
Figure 144:
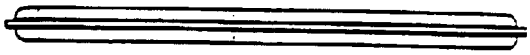
Figure 142:
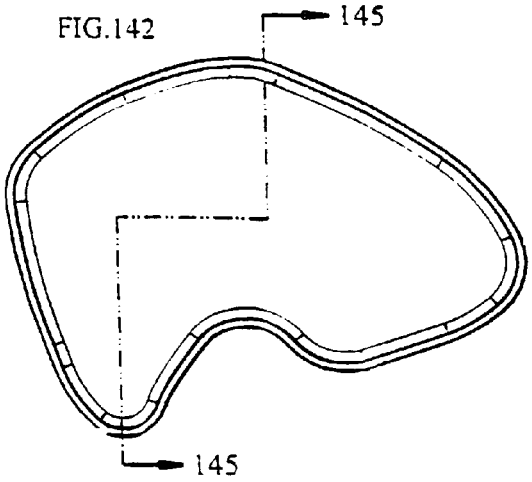
Figure 143:
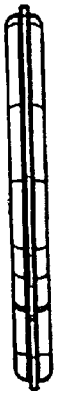
Figure 145:
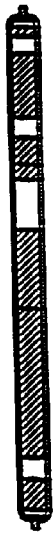
Figure 147:
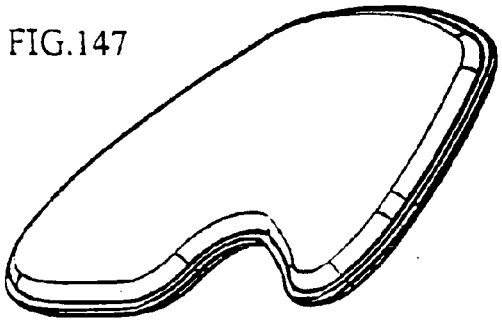
Figure 150:
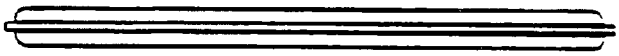
Figure 148:
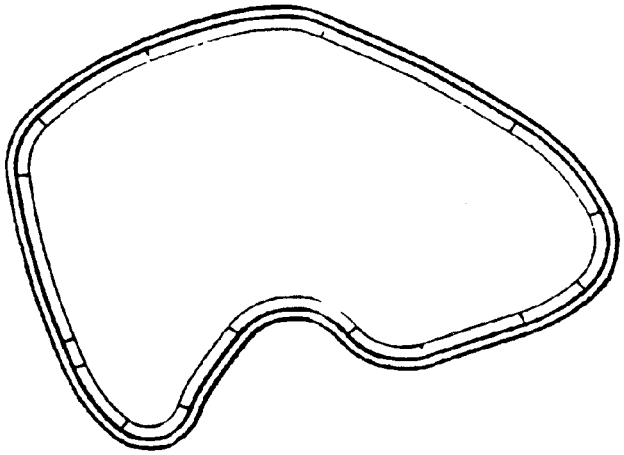
Figure 149:
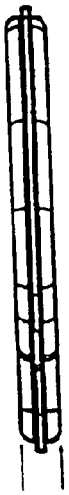
Figure 151:
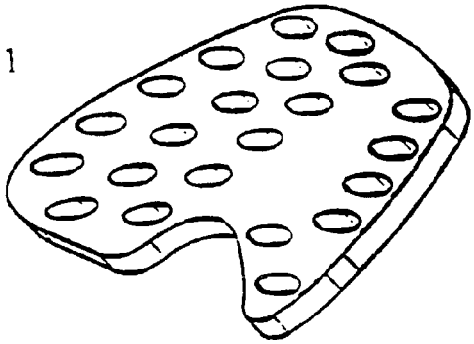
Figure 154:
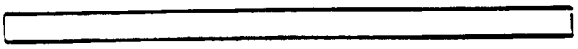
Figure 152:
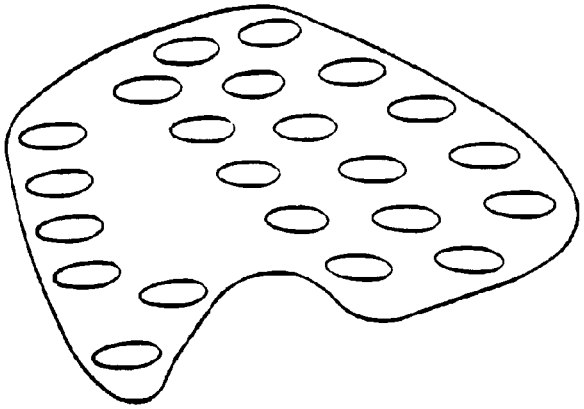
Figure 153:
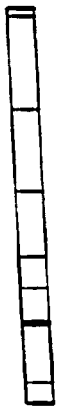
Figure 160:
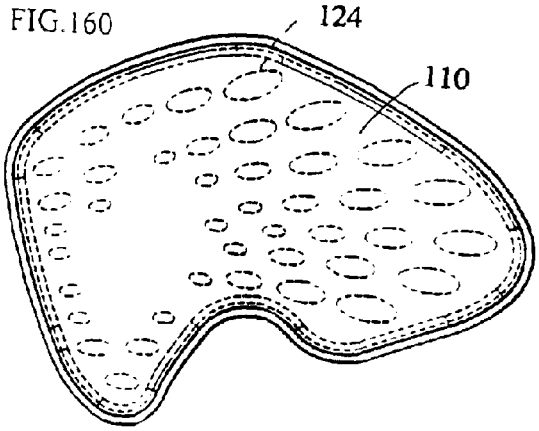
Figure 155:
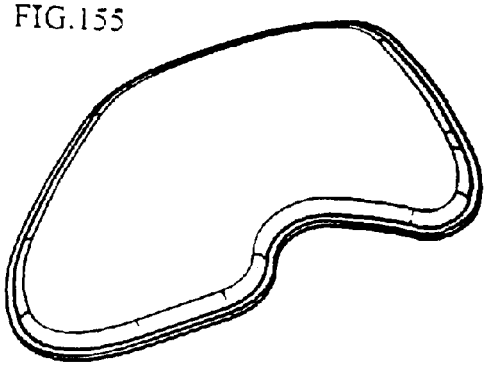
Figure 158:
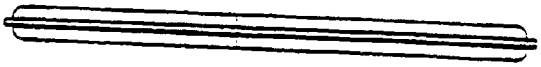
Figure 156:
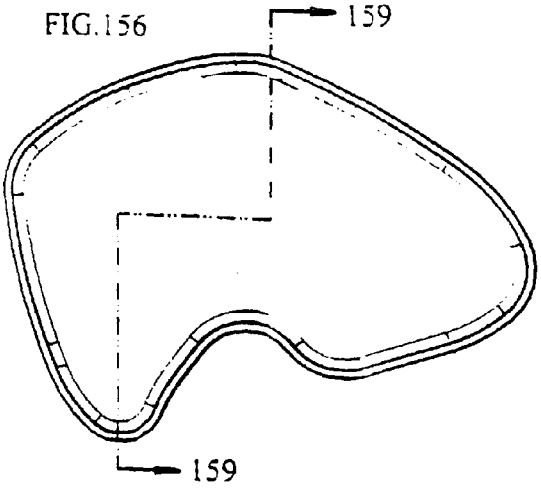
Figure 157:
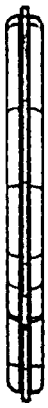
Figure 159:
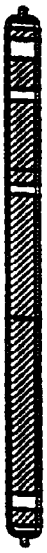
Figure 161:
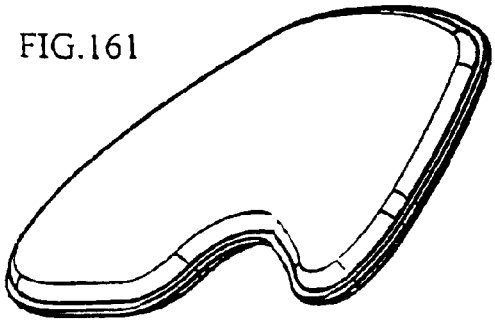
Figure 164:
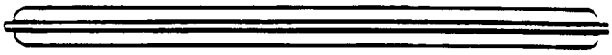
Figure 162:
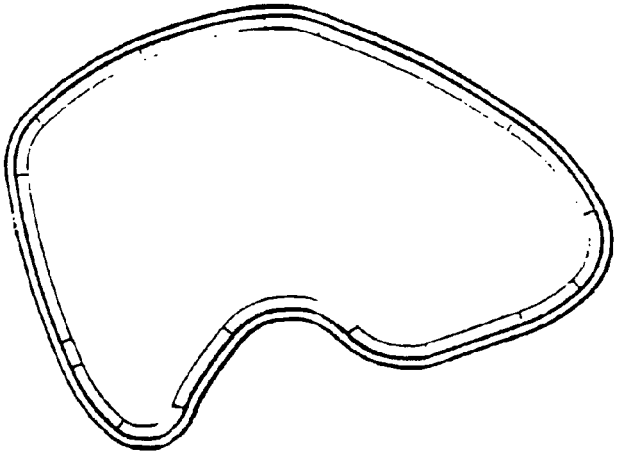
Figure 163:
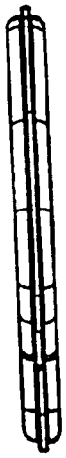
Figure 165:
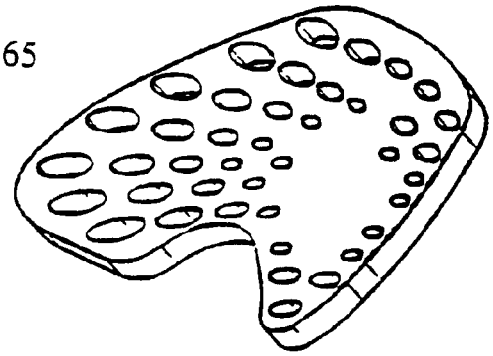
Figure 168:
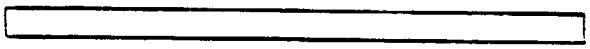
Figure 166:
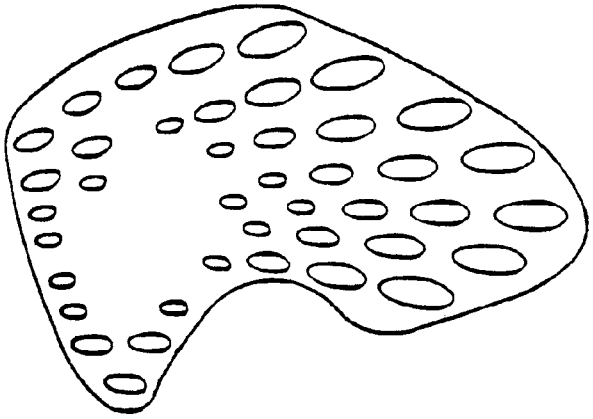
Figure 167:
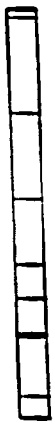
Figure 169:
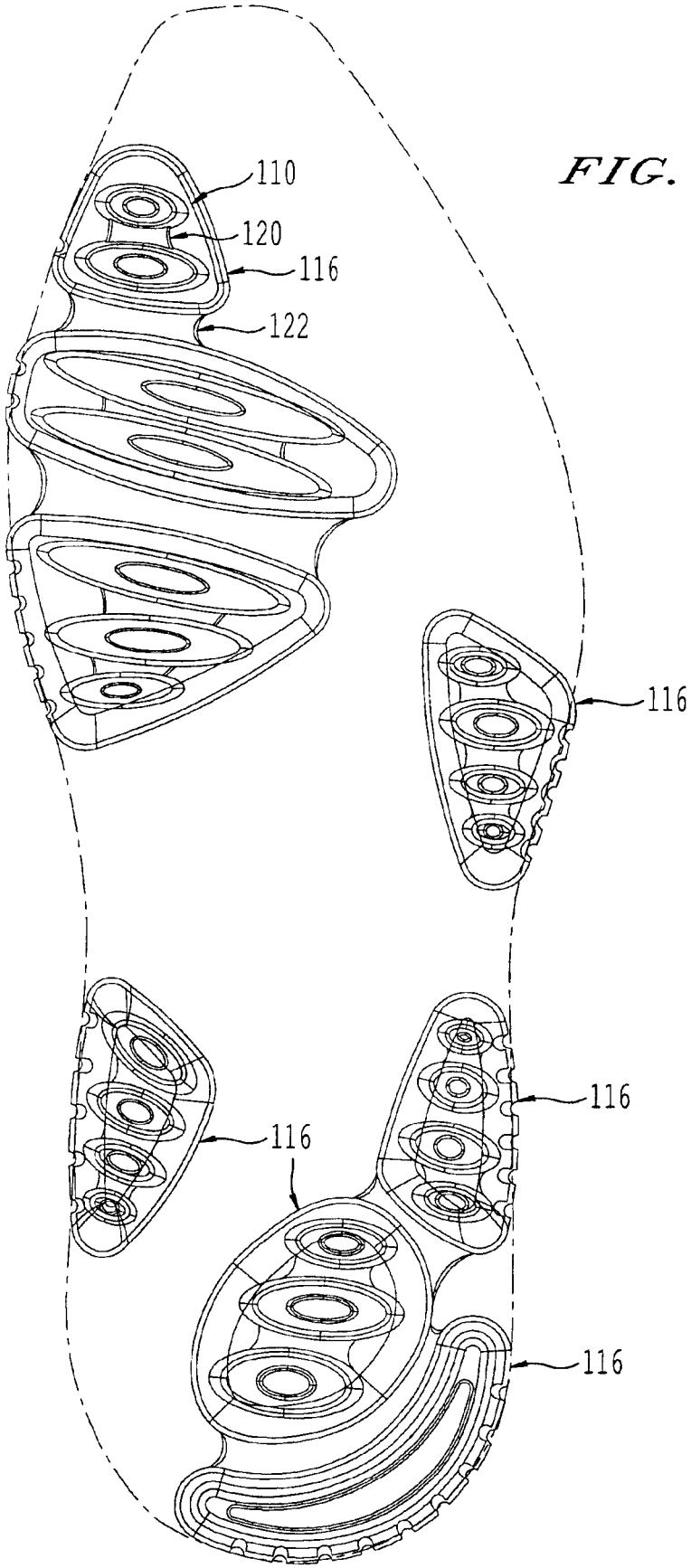
Figure 170:
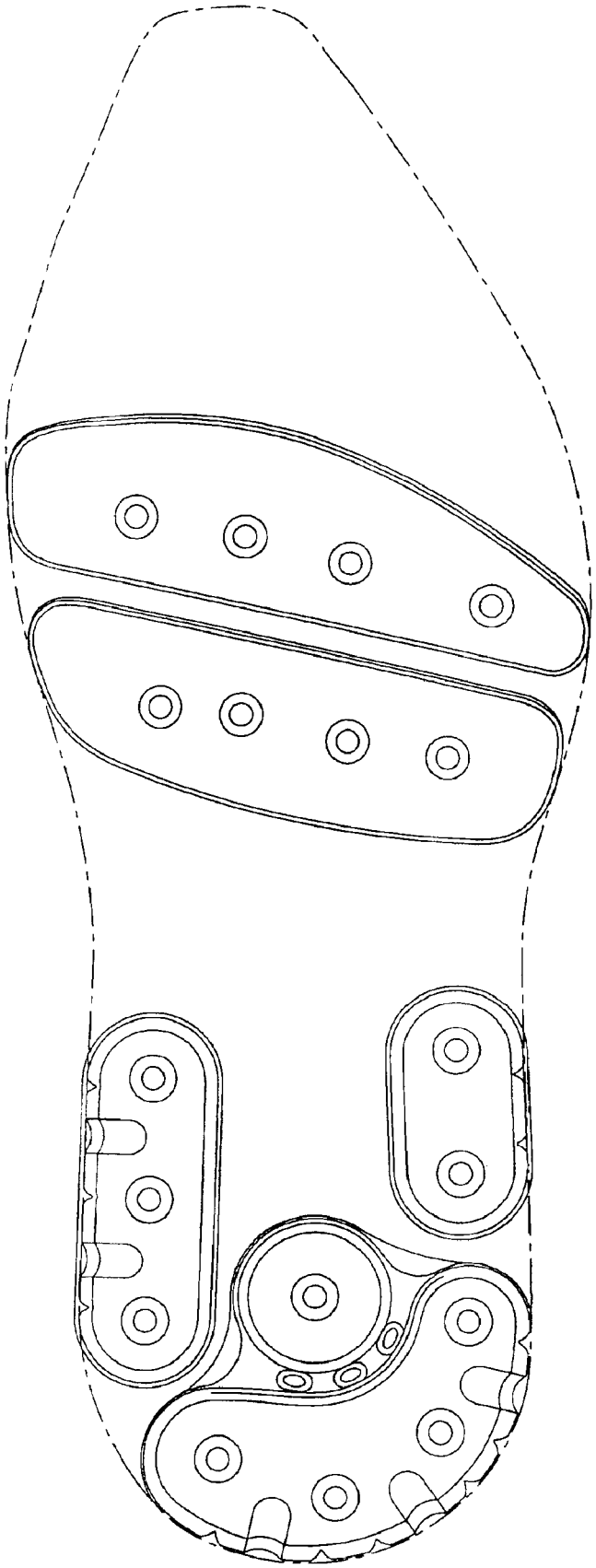
Figure 171:
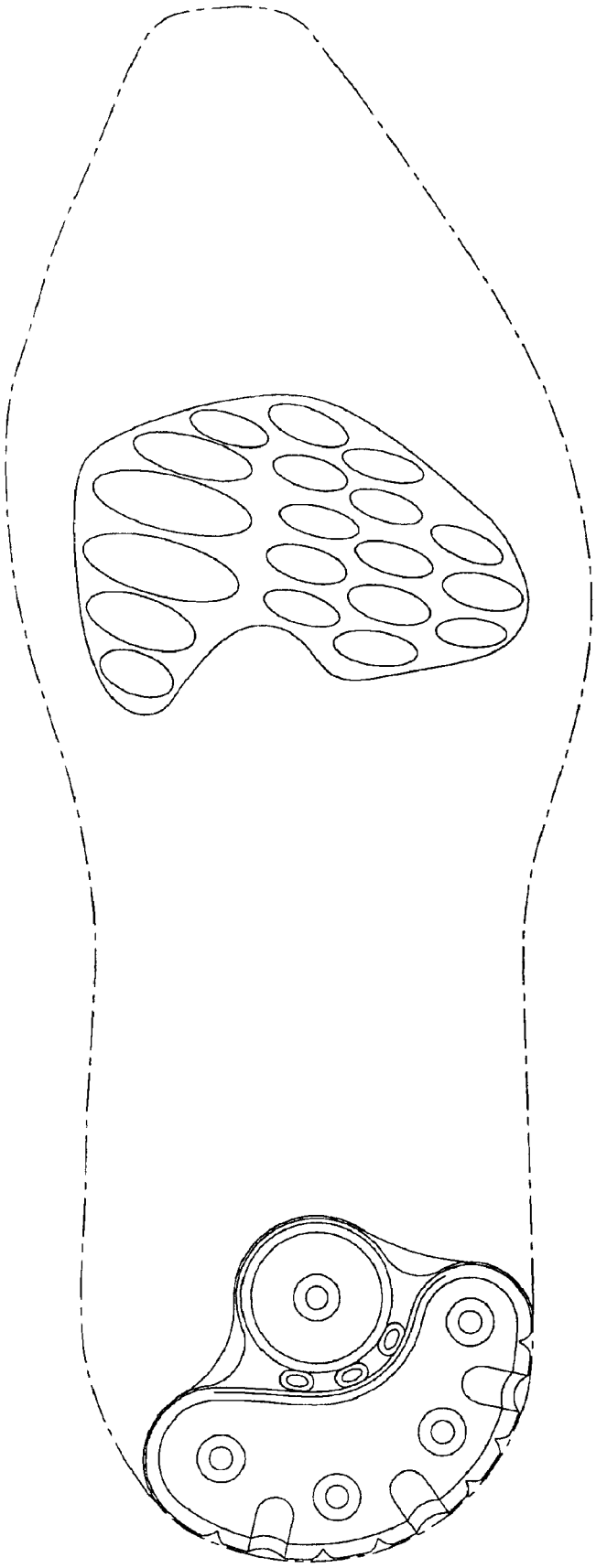
Figure 172:
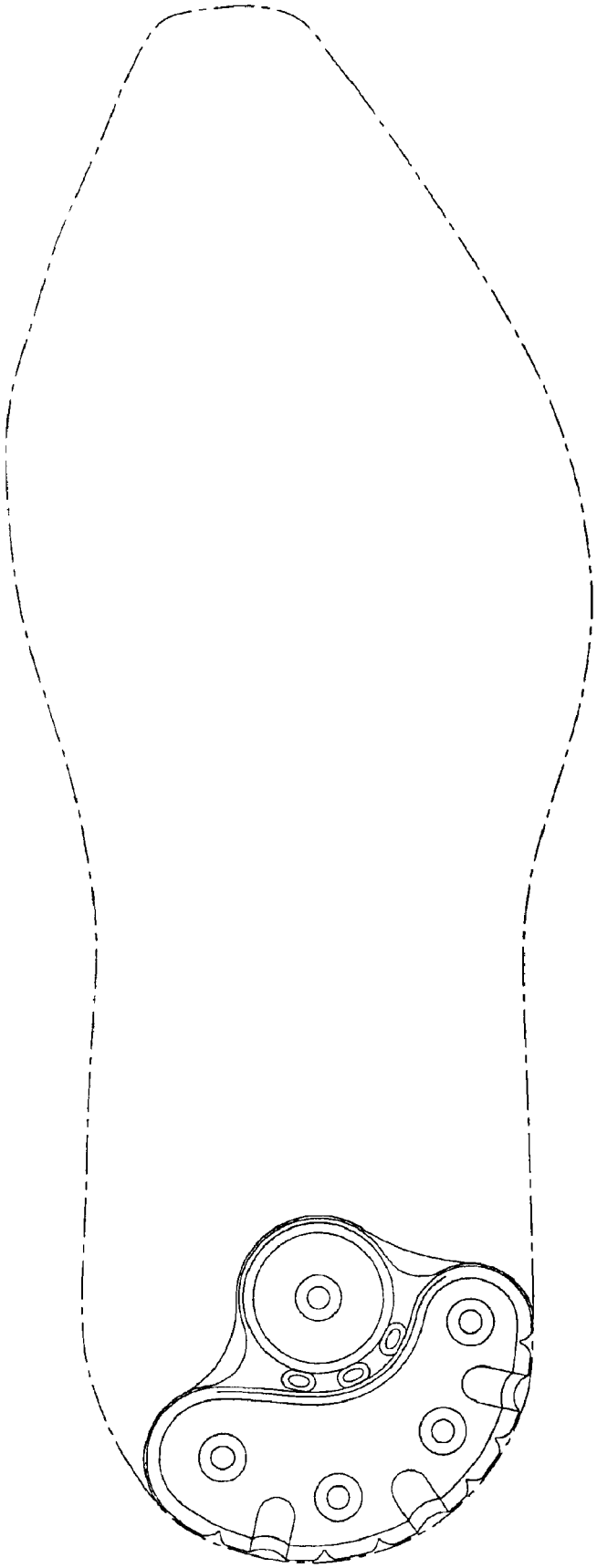
Figure 173:
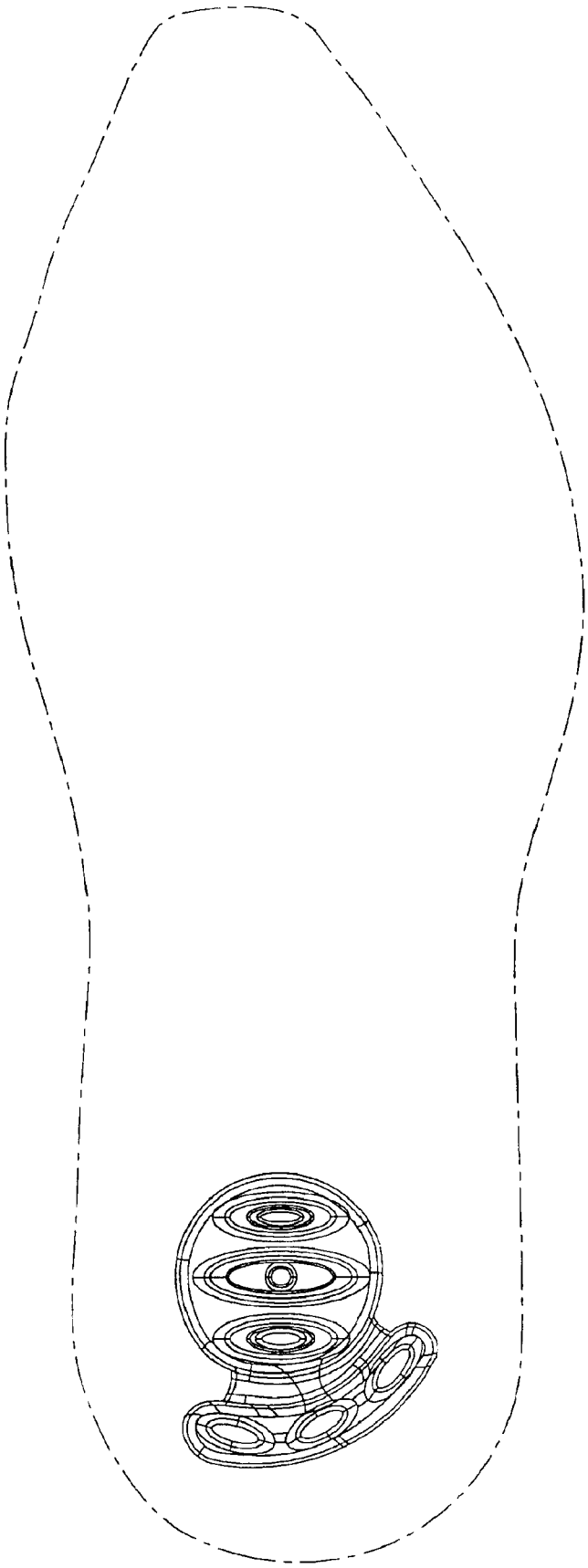
Figure 174:
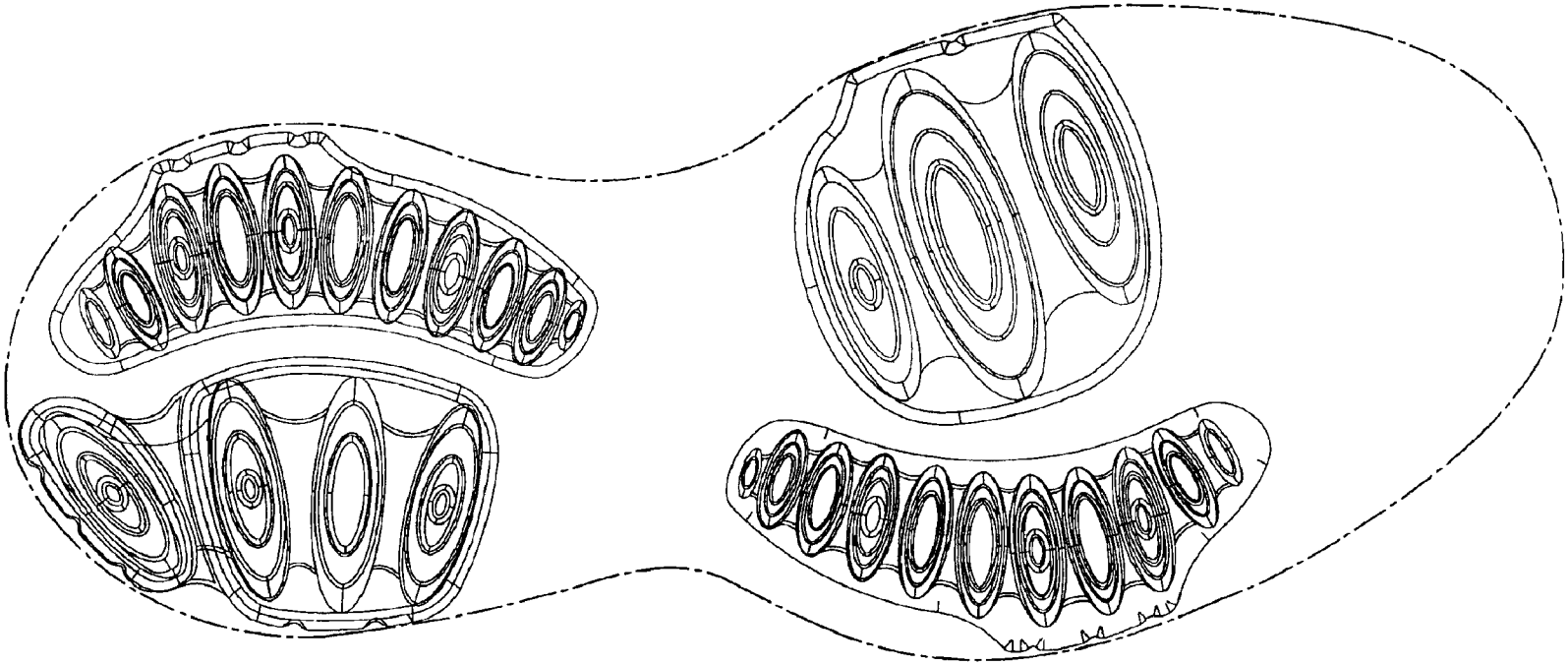
Figure 175:
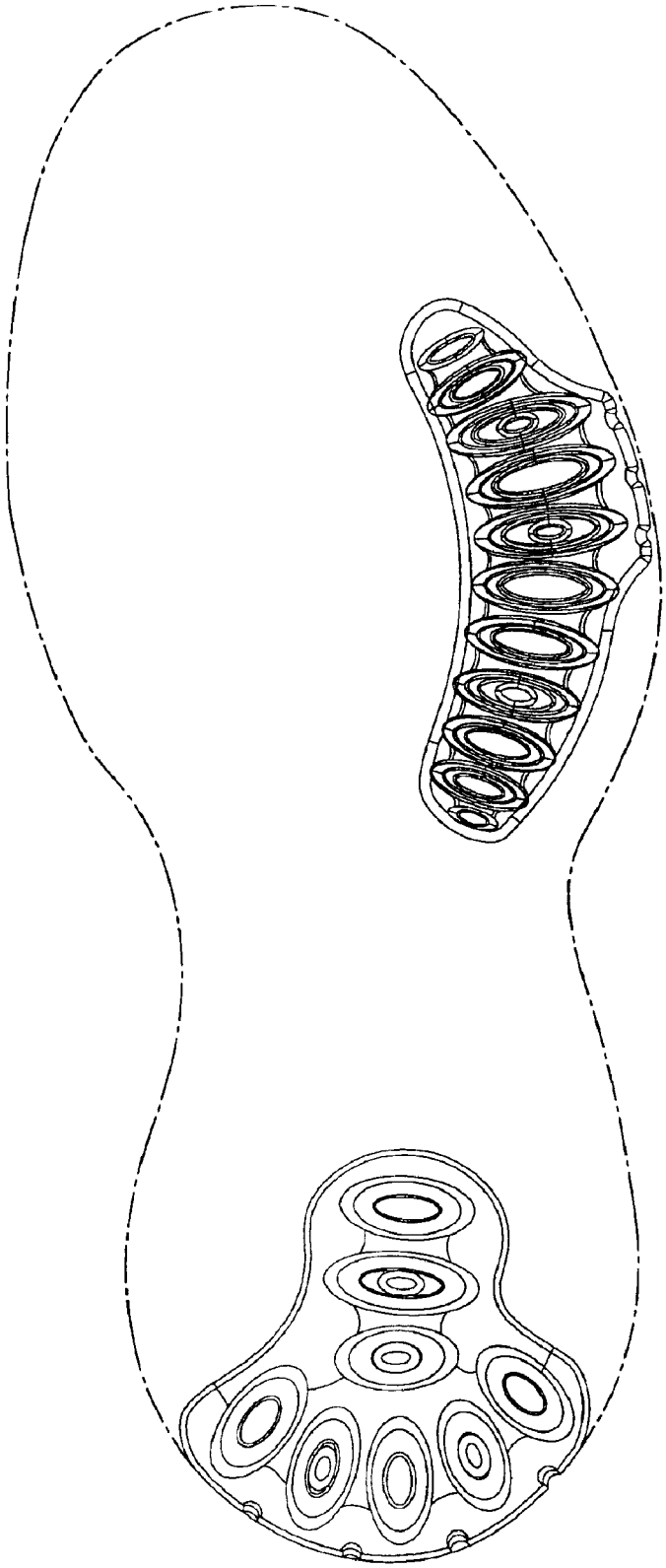
Figure 176:
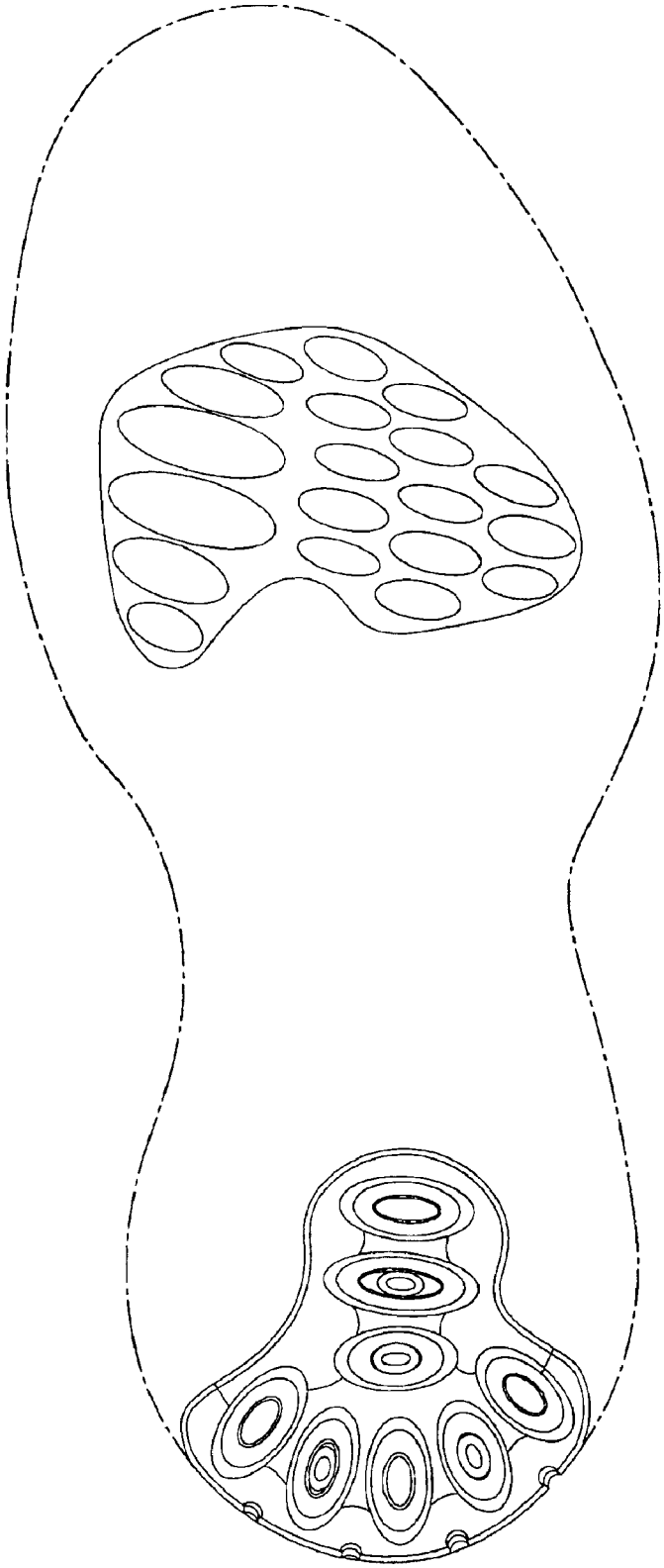
Figure 177:
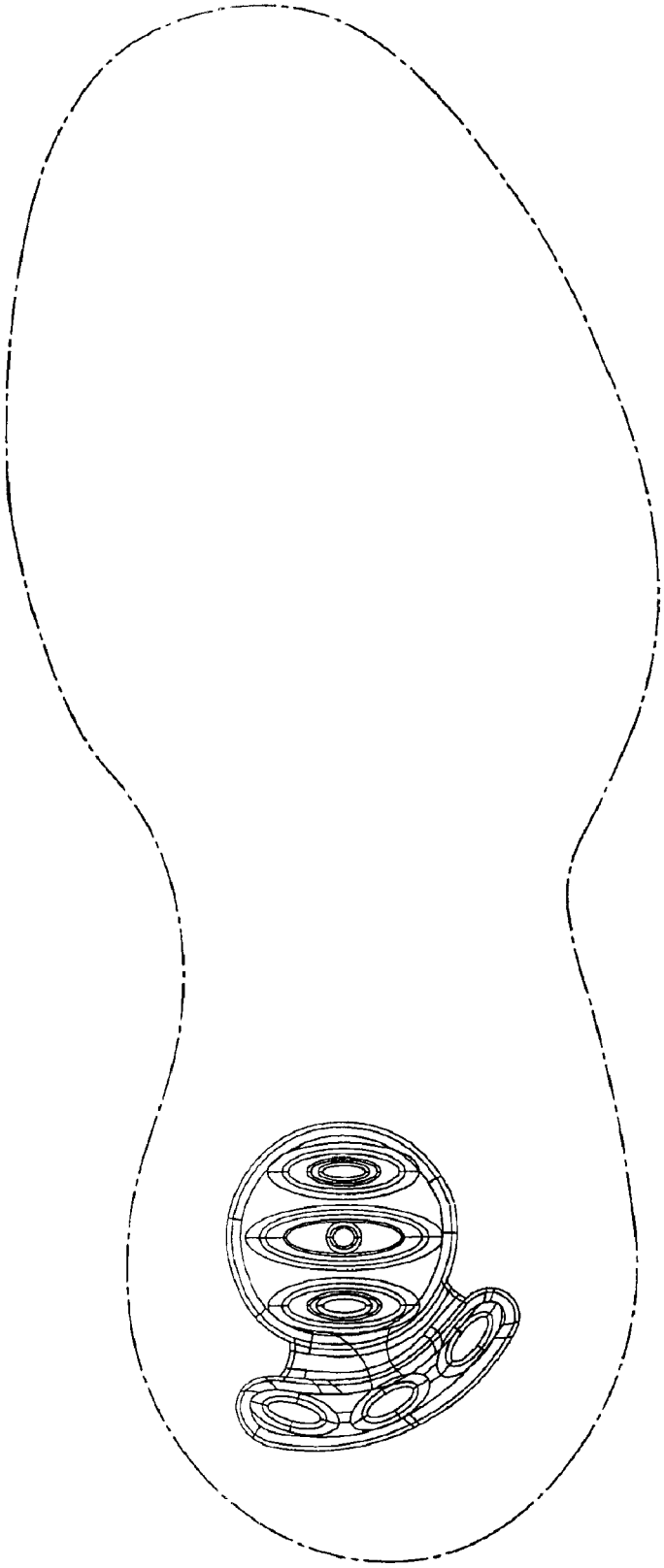
Figure 178:
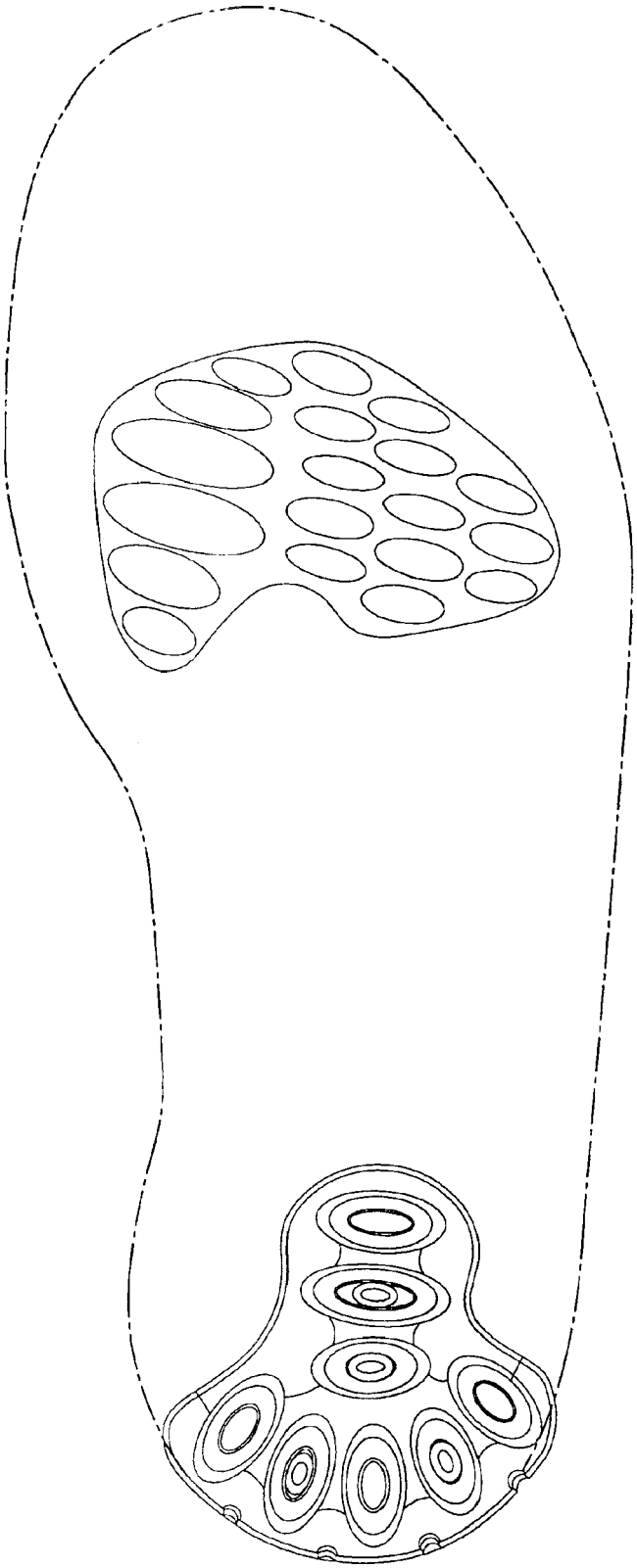
Figure 179:
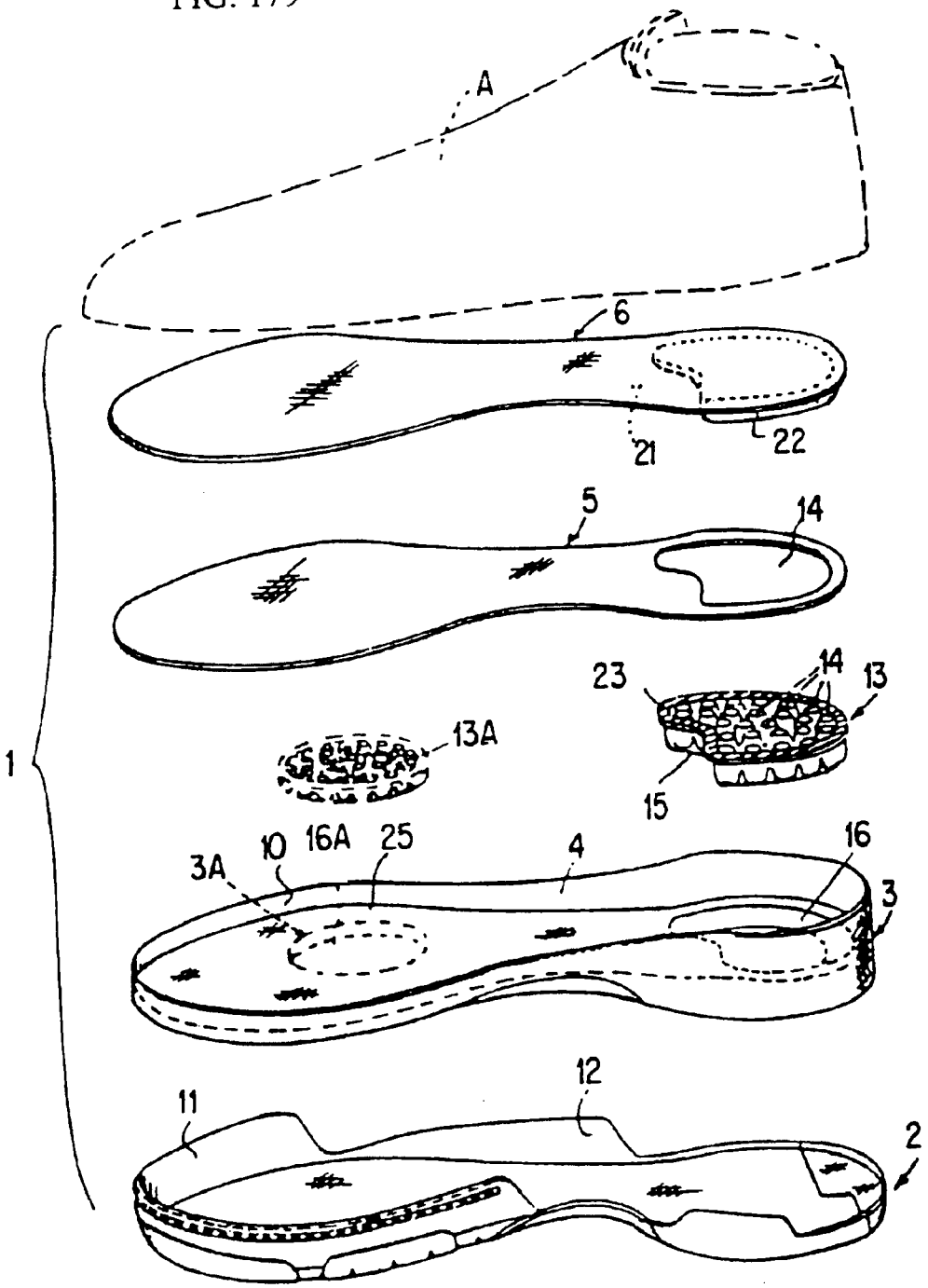
Figure 182:
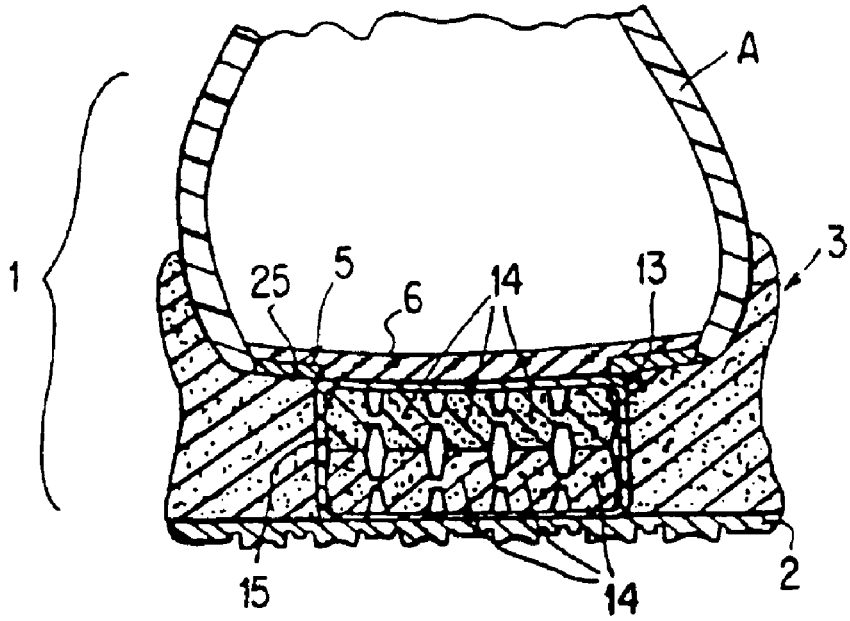

FIG. 131 is a cross-sectional view thereof taken along line 130—130 of FIG. 128;

FIG. 132 is a top plan view thereof showing the pillars of the insert in phantom lines;

FIG. 133 is a top, front and right side perspective view of another embodiment of the present invention;

FIG. 134 is a top plan view thereof, the bottom plan view being a mirror image of the top plan view shown;

FIG. 135 is a right side elevational view thereof;

FIG. 136 is a rear elevational view thereof;

FIG. 137 is a top, front and left side perspective view of another embodiment of the present invention;

FIG. 138 is a top plan view thereof, the bottom plan view being a mirror image of the top plan view shown;

FIG. 139 is a right side elevational view thereof;

FIG. 140 is a rear elevational view thereof;

FIG. 141 is a top, rear and left side perspective view of another embodiment of the present invention;

FIG. 142 is a top plan view thereof, the bottom plan view being a mirror image of the top plan view shown;

FIG. 143 is a right side elevational view thereof;

FIG. 144 is a rear elevational view thereof;

FIG. 145 is a cross-sectional view thereof taken along line 145—145 of FIG. 142;

FIG. 146 is a top plan view thereof showing the pillars of the insert in phantom lines;

FIG. 147 is a bottom, front and left side perspective view of another embodiment of the present invention;

FIG. 148 is a top plan view thereof, the bottom plan view being a mirror image of the top plan view shown;

FIG. 149 is a right side elevational view thereof;

FIG. 150 is a rear elevational view thereof;

FIG. 151 is a bottom, front and right side perspective view of another embodiment of the present invention;

FIG. 152 is a top plan view thereof, the bottom view being a mirror image of the top plan view shown;

FIG. 153 is a right side elevational view thereof;

FIG. 154 is a rear elevational view thereof;

FIG. 155 is a bottom, front and right side perspective view of another embodiment of the present invention;

FIG. 156 is a top plan view thereof, the bottom view being a mirror image of the top plan view shown;

FIG. 157 is a right side elevational view thereof;

FIG. 158 is a rear elevational view thereof;

FIG. 159 is a cross-sectional view thereof taken along line 159—159 of FIG. 156;

FIG. 160 is a top plan view thereof showing the pillars of the insert in phantom lines;

FIG. 161 is a bottom, front and left side perspective view of another embodiment of the present invention;

FIG. 162 is a top plan view thereof, the bottom plan view being a minor image of the view shown;

FIG. 163 is a right side elevational view thereof;

FIG. 164 is a rear elevational view thereof;

FIG. 165 is a bottom, front and left side perspective view of another embodiment of the present invention;

FIG. 166 is a top plan view thereof, the bottom plan view being a mirror image of the view shown;

FIG. 167 is a right side elevational view thereof;

FIG. 168 is a rear elevational view thereof;

FIG. 169 shows on a reduced scale an example of the orientation of the inserts in a article of footwear utilizing the embodiments of FIGS. 1–6, 7–13, 85–93 and 106–112;

FIG. 170 shows on a reduced scale the inserts in an article of footwear which utilizes the embodiments of FIGS. 27–33, 34–40 and 41–47;

FIG. 171 shows on a reduced scale an article of footwear which utilizes the inserts of FIGS. 27–33 and 125–130;

FIG. 172 illustrates on a reduced scale an article of footwear utilizing the inserts of FIGS. 27–33;

FIG. 173 shows on a reduced scale an article of footwear utilizing the embodiment illustrated in FIGS. 53–61;

FIG. 174 shows on a reduced scale an article of footwear utilizing the embodiments of FIGS. 106–112, 73–119 and 120–126;

FIG. 175 illustrates on a reduced scale an article of footwear utilizing the embodiments of FIGS. 77–83 and 106–112;

FIG. 176 illustrates on a reduced scale an article of footwear utilizing the embodiments of FIGS. 77–84 and 127–132;

FIG. 177 illustrates on a reduced scale an article of footwear utilizing the embodiments of FIGS. 53–59;

FIG. 178 illustrates on a reduced scale an article of footwear utilizing the embodiments of FIGS. 77–84 and 127–132;

FIG. 179 is an exploded view of the lower part of an article of footwear for a conventional article of footwear;

FIG. 180 is a bottom view thereof;

FIG. 181 is a section view taken along lines 181—181 of FIG. 180;

FIG. 182 is a section view of an alternate embodiment of the conventional article of footwear of FIG. 179.

DESCRIPTION OF THE PREFERRED EMBODIMENTS

With respect to the embodiments shown in FIGS. 1 through 178, these are directed to improved deformable elements and specific arrangements optimized for the biomechanics of a user's foot. In particular, FIGS. 1 through 168 disclose improved shapes of the elastically deformable elements, and arrangements therefore within airtight casings. For example, FIG. 6 illustrates an arrangement of elastically deformable elements which are substantially oval shaped in cross-section. According to another aspect of the invention, the deformable elements have been cored, wherein a hole has been formed through the center of the deformable element in order to reduce the weight of the element. For example, FIG. 6 illustrates an arrangement of elastically deformable members 110 which are substantially oval in a cross-section. Deformable members 110 are provided with holes 112 which reduce their weight. It is also conceived that deformable elements 110 are dimpled or otherwise reduced in order to minimize the weight of elements 110. Preferably, elements 110 are vacuumed sealed in a casing 114. The edges of elements 110, are tapered as shown in dashed lines in FIG. 6 and illustrated as recesses 118 in FIG. 5. FIG. 6 shows an arrangement of deformable elements 110 which are broken down into three deformable element batteries 116, wherein each battery includes at least two deformable elements 110 which are joined by integral bridging portions 120. Each of the deformable element batteries 116 are joined by battery bridging portion 122. Preferably, bridging portions 122 are integrally formed with casing 114 which is vacuum sealed around elements 110.

The advantage achieved by forming deformable elements 110 with an oval cross-section, is that it is possible to use larger elements which provide a more continuous contact and therefore more evenly distributed energy transfer between the user's foot and the element, while maintaining the flexibility necessary in an article of footwear sole. For example, it has been found that it is more costly to provide an array of elastic members including a large number of elements 110, and that the flexibility of the resulting sole is reduced if larger elements are used. It has also been found that deformable elements that are substantially round or barrel shaped do not flex with the sole of the article of footwear during use and therefore do not provide continuous support of the user's foot during use. In order to provide better support of the user's foot, the present invention employs the use of oval deformable elements 110 connected by bridging portion 120. Constructed as such, deformable battery 116, for example, can more easily bend along bridging portion 120. Therefore, an aspect of the invention is to align deformable elements 110 such that bridging portions 120 are aligned with flex lines of a foot. The flex lines referred to are generally known in that when a user is walking or running, the sole of the user's foot bends throughout each step. Therefore an aspect of the invention is to construct deformable elements 110 and batteries 116 such that deformable elements 110 can flex with the bend lines of a foot and thereby better follow and maintain contact with the sole of a user's foot.

Another advantage attained by the invention, is that casing or encapsulating bag 114 is formed by a vacuum forming or blow molding which thereby eases and lowers the cost of manufacturing.

Another aspect of the invention is that the arrangement, stiffness and viscoelastic properties of deformable elements are varied throughout positions in the sole in order to match the biomechanics of the user's foot, and preferably, according to the particular athletic activity.

FIGS. 160–167 show that a deformable element 110 may comprise a single unitary member having either a plurality of holes 124 or none at all to best suit the effect on the foot of the user and to minimize weight where necessary.

FIGS. 169–178 disclose a variety of arrangements of deformable elements 110 and deformable batteries 116 according to a particular athletic activity. As shown in FIG. 169, deformable elements 110 are arranged inside deformable batteries 116 such that bridging portions 120 and 122 are aligned with flex lines of the foot. Therefore, bridging portions 120, 122 allow deformable elements 110 and batteries 116 to flex as the sole of the user's foot flexes during an athletic activity.

The arrangement shown in FIG. 169, is optimized for running. A heel unit is aligned with the first contact area of the sole with the ground during the heel strike phase of running gait. The rearmost battery of the heel unit is hinged to the central battery of the heel unit to reduce the accelerating leverage that results from the heel striking a unitary cushioning element. A separate battery of the heel unit is placed toward the arch of a wearer's foot and is made more stiff than the other parts of the heel unit. This arrangement reduces the pronation rate of a wearer and thus reduces the risk of chronic stability related injuries.

A forefoot section of three parts is provided at least under the first and second metatarsal-phalangeal joints of a wearer. This is an area exposed to great stress during the push off phase of the running gait. A narrowed and hinged segmental arrangement is provided in the forefoot area unit and includes a hinge 122 leading to a battery under the wearer's great toe. A hinge 120 between the elements may be provided at any point in the structure such that the hinge is in general alignment with the joints of a wearer's foot or is oriented to match with the rotational distortion of the sole and midsole resulting from their flexion and compression during foot contact with the ground common to running.

FIGS. 170 through 173 show alternative embodiments for arrangements optimized for running. FIG. 170 includes a separate element placed on the medial border of the sole, generally under the wearer's arch. This has a greater stiffness then the other elements in the heel area of this arrangement to reduce the degree or rate of pronation of a wearer's foot during running. The forefoot has two separate elements with an area of separation corresponding generally to the metatarsal-phalangeal joints of a wearer. FIG. 171 includes a forefoot pad under the first, second and third metatarsal-phalangeal joints of a wearer. The barrel elements shown therein are ovoid and their longitudinal axis is generally aligned with the flex lines of a wearer's foot to permit greater ease of flexion.

FIG. 172 shows a heel element with a hinged portion between the central heel cushioning portion and a lateral cushioning portion positioned to absorb some impact energy upon the heel striking the same. The hinging reduces the tendency of a heel to act as a unitary plate of material and thus reduces the leveraged acceleration of the sole towards the ground. This in turn reduces the rate of pronation of a wearer.

FIG. 173 shows a heel element with a hinged portion between the central heel cushioning portion and a lateral cushioning portion positioned to absorb some impact energy at heel strike. The rear lateral border of the pad is positioned away from the outside border of the sole and midsole to permit encapsulation of the parts with a foam such as PU or EVA.

Similarly, FIGS. 174 through 177 illustrate arrangements optimized for basketball. FIG. 174 shows a sole including two heel and two forefoot elements divided about a generally longitudinal axis. This division reduces the tendency of the cushioning elements to act as a monolithic sheet and thus reduces the leveraged acceleration resulting from forceful ground impacts on the lateral or medial borders of the article of footwear. These impacts may occur during landing on a court surface after jumping in the air.

FIG. 175 includes cushioning elements at the rear of the heel to protect the wearer from impact shock during running on a court surface. The forefoot includes a laterally placed element. This reduces the tendency of the sole to collapse under the forefoot lateral border during the motion known as cutting, or the application of other rapid lateral shearing forces to the article of footwear.

FIG. 176 provides a heel cushion for court running actions and a forefoot pad positioned in from the borders of the sole. This permits full encapsulation of the element in foam to reduce manufacturing costs while still permitting a user the extraordinary benefits of the cushioning elements featured in this invention.

FIG. 177 shows an article of footwear sole including a heel cushioning element provided for comfort during the running phase of basketball game. This is positioned inward from the border of the sole to permit full encapsulation of the part in foam.

Finally, FIG. 178 illustrates an arrangement optimized for tennis. FIG. 178 shows a sole featuring two aspects of the present invention. The heel provides cushioning under the calcaneus of a wearer during the heel strike motions associated with lunging for a stroke or running on the heels. A separate forefoot section cushions the foot under the first four metatarsal-phalangeal joints of a wearer. This is an area exposed to stress by the motions of service and many movements needed to position a player for optimum return strokes.

The disclosure of provisional application serial No. 60/073,576 upon which this application is based is incorporated herein by reference.

Obviously, numerous modifications and variations of the present invention are possible in light of the above teachings. It is therefore to be understood that within the scope of the appended claims, the invention may be practiced otherwise than as specifically described herein.

What is claimed is:

1. An article of footwear, which comprises:

a vamp;

a lower support connected to said vamp; and at least one insert mounted in said lower support and which includes first and second airtight casings each having a plurality of elements positioned therein which are elastically deformable such that the biomechanics of a foot of a user are optimized wherein said deformable elements comprises at least a first and second battery of said deformable elements respectively placed in said first and second casings, said first and second casings being interconnected by a bridging portion, and said deformable elements being interconnected by integral bridging portions for permitting flexibility between the first and second casings, said deformable elements each having a substantially oval-shaped horizontal cross-section, wherein said bridging portion of said first and second casings is aligned with a flex line of the foot of the user and wherein at least one of said elements of said first battery extends across substantially an entire width portion of said first casing.

2. An article of footwear as claimed in claim 1, wherein the air pressure in said casing is less than atmospheric pressure.

3. An article of footwear as claimed in claim 1, wherein said deformable elements comprise cored elements for reducing the weight thereof.

4. An article of footwear as claimed in claim 2, wherein said deformable elements comprise dimpled elements for reducing the weight thereof.

5. An article of footwear as claimed in claim 1, wherein said deformable elements are interconnected by bridging portions.

6. An article of footwear as claimed in claim 1, wherein said deflatable elements have an oval cross-section.

7. An article of footwear as claimed in claim 5, wherein said elements comprise batteries of deformable elements.

8. An article of footwear as claimed in claim 5, wherein said bridging portions are aligned with flex lines of the foot of the user.

9. An article of footwear as claimed in claim 5, wherein said bridging portions are integrally formed with said casing.

10. An article of footwear as claimed in claim 1, wherein said deformable elements are located in at least one of the heel portion, lateral portion, forefoot portion and metatarsal portion of the lower support.

11. An article of footwear as claimed in claim 1, wherein said elements are substantially oval shaped in cross-section.

12. An article of footwear as claimed in claim 11, wherein said elements comprise cored elements for reduction of weight of said elements.

13. An article of footwear as claimed in claim 11, wherein said elements are interconnected by bridging portions.

14. An article of footwear as claimed in claim 13, wherein said bridging portions are connected to said airtight casing.

15. An article of footwear as claimed in claim 11, wherein said elements comprise batteries of at least three elements that are interconnected by bridging portions.

16. An article of footwear as claimed in claim 11, which comprises a hinge member which interconnects adjacent elements wherein said hinge member is one of a hinge in alignment with at least one joint of a wearer's foot and a hinge which is oriented to match a rotational distortion thereof.

17. An article of footwear as claimed in claim 1, wherein at least one of said elements is located on a medial border of a sole portion of the article of footwear so as to be positioned substantially beneath an arch portion of the foot.

18. An article of footwear as claimed in claim 1, wherein said elements include an element located in a heel portion of the midsole and wherein said at least one element has a stiffness greater than said element located at the heel portion of the midsole so as to reduce the degree of pronation of the foot of the user during running.

19. An article of footwear as claimed in claim 17, wherein a forefoot portion of said at least one element comprises two adjacent separate elements with an area of separation therebetween corresponding generally to a metatarsal-phalangeal joint of the foot of the user.

20. An article of footwear as claimed in claim 17, wherein a portion of said at least one element includes a forefoot pad located under a first, second and third metatarsal-phalangeal joint of the foot.

21. An article of footwear as claimed in claim 17, wherein said at least one element includes a plurality of ovoid barrel elements having a longitudinal axis aligned with flex lines of the user's foot to permit greater ease of flexion.

22. An article of footwear as claimed in claim 1, wherein said at least one insert comprises a heel insert having a central heel cushioning portion and a lateral cushioning portion with a hinged portion interconnecting said central heel cushioning portion and said lateral cushioning portion for absorbing impact forces from the heel of the foot of the user and for reducing leveraged acceleration of the sole towards the ground as well as a rate of pronation of the user.

23. An article of footwear as claimed in claim 1, wherein said at least one insert comprises a heel insert having a central heel portion, a lateral cushioning portion and a hinged portion interconnecting said central heel portion and said lateral cushioning portion.

24. An article of footwear as claimed in claim 23, wherein a rear lateral border portion of said insert is distanced from an outside border of the sole and midsole to permit encapsulation of insert with a foam member.

25. An article of footwear as claimed in claim 11, wherein said insert comprises first and second heel elements and first and second forefoot elements divided about a substantially longitudinal axis so as to reduce leveraged acceleration of the foot of the user.

26. An article of footwear as claimed in claim 11, wherein said insert comprises a plurality of cushioning elements located at a rear portion of the heel and at least one laterally positioned forefoot element to reduce any tendency of the sole to collapse under a forefoot lateral border portion of the sole during a cutting motion of the user when running.

27. An article of footwear as claimed in claim 26, wherein said at least one laterally positioned forefoot element comprises a single element.

28. An article of footwear as claimed in claim 11, wherein said insert comprises at least one heel element and a forefoot pad positioned inwardly from adjacent borders of the sole to permit encapsulation thereof in the sole.

29. An article of footwear as claimed in claim 11, wherein said insert comprises a heel cushioning element positioned inwardly from an adjacent border of the sole to permit full encapsulation of said element in the midsole.

30. An article of footwear as claimed in claim 11, wherein said insert comprises a heel element for providing cushioning under the calcaneus portion of the foot and a separate forefoot element for cushioning the foot under the first four metatarsal-phalangeal joints of the foot.

31. A method of forming an insert for an article of footwear, which comprises:

forming at least one insert from a plurality of interconnected elements;

inserting said elements into first and second casings so as to be positioned in a midsole portion of an article of footwear such that the biomechanics of a foot of a user wearing the article of footwear are optimized wherein the step of forming the interconnected element comprises forming at least two batteries of deformable elements so as to be respectively positioned in said first and second casings wherein said deformable elements are each substantially oval-shaped in horizontal cross-section and wherein at least one of battery elements extends across substantially an entire width portion of said first casing, the step of forming the elements comprises forming at least two batteries of said deformable elements, and interconnecting said first and second casings by a bridging portion aligned with a flex line of the foot of a user wherein the step of forming the deformable elements comprises interconnecting said deformable elements by integral bridging portions.

32. The method as claimed in claim 31, wherein the step of forming the interconnected element comprises forming elements which are substantially oval shaped in cross-section.

33. The method as claimed in claim 31, wherein the step of forming the elements comprises forming cored elements for reduction of weight of said elements.

34. The method as claimed in claim 31, wherein the step of forming the elements comprises forming elements which are interconnected by bridging portions.

35. The method as claimed in claim 34, which comprises interconnecting the bridging portions with an airtight casing.

36. The method as claimed in claim 31, wherein the step of forming of the elements comprises forming elements as batteries of at least three elements and interconnecting said batteries by bridging portions.

37. The method as claimed in claim 31, which comprises interconnecting adjacent elements of said plurality of elements with hinge members wherein said hinge members comprise one of hinge members in alignment with at least one joint of the user's foot and a hinge oriented so as to match a rotational distortion thereof.

38. A method as claimed in claim 31, which comprises the step of forming the elements such that at least one of the elements is located on a medial border of a sole portion of the article of footwear so as to be positioned substantially beneath an arch portion of the foot.

39. The method as claimed in claim 31, wherein the step for forming the elements comprises forming the elements so as to include an element located in a heel portion of the midsole and forming at least one of said elements so as to have a stiffness greater than the element located at the heel portion of the midsole so as to reduce a degree of pronation of the foot during running.

40. The method as claimed in claim 31, which comprises locating at least one of the elements in a forefoot portion of the article of footwear so as to have two adjacent separate elements with an area of separation therebetween corresponding generally to a metatarsal-phalangeal joint of the foot.

41. The method as claimed in claim 31, which comprises locating at least one of the elements in a forefoot portion of the sole so as to include a forefoot pad located under a first, second and third metatarsal-phalangeal joint of the foot.

42. The method as claimed in claim 38, wherein the forming of the elements comprises forming at least one element so as to include a plurality of ovoid barrel elements having a longitudinal axis aligned with flex lines of the user's foot to permit greater ease of flexion.

43. The method as claimed in claim 31, wherein the step of inserting at least one insert comprises inserting at least one insert in a central heel cushioning portion of the midsole and locating a lateral cushioning portion in the sole with a hinge portion interconnecting the central heel cushioning portion and the lateral cushioning portion so as to absorb impact forces from the heel portion of the foot and to reduce leveraged acceleration of the midsole towards the ground as well as a rate of pronation.

44. The method as claimed in claim 31, wherein inserting the insert comprises inserting a heel insert into the midsole having a central heel portion, a lateral cushioning portion and a hinge portion interconnecting the central heel portion and said lateral cushioning portion.

45. The method as claimed in claim 44, which comprises distancing a rear lateral border portion of said insert from an outside border of the shoe and the midsole to permit encapsulation of the insert with the foam member.

46. The method as claimed in claim 31, wherein the step of inserting the insert comprises inserting an insert having at least first and second heel elements and first and second forefoot elements and divided about a substantially longitudinal axis so as to reduce leveraged acceleration on the foot.

47. The method as claimed in claim 31, wherein the step of inserting the insert comprises inserting an insert having a plurality of cushioning elements located at a rear portion of the heel and at least one laterally positioned forefoot element to reduce any tendency of the sole to collapse under a forefoot lateral border portion on the midsole during a cutting motion of the user when running.

48. The method as claimed in claim 47, wherein at least said laterally positioned forefoot element comprises a single element.

49. The method as claimed in claim 31, wherein the step of inserting the insert comprises inserting an insert having at least one heel element and a forefoot pad positioned inwardly from adjacent borders of the midsole so as to permit encapsulation thereof in the midsole.

50. The method as claimed in claim 31, wherein the step of inserting the insert comprises inserting a heel cushioning element positioned inwardly from an adjacent border of the midsole to permit full encapsulation of the element in the midsole.

51. The method as claimed in claim 31, wherein the step of inserting the insert comprises inserting an insert which includes a heel element for providing cushioning under the calcaneus portion of the foot and a separate forefoot element for cushioning the foot under the first four metatarsal-phalangeal joints of the foot.

52. Particle of footwear as claimed in claim 1, wherein said elements are substantially H-shaped in vertical cross-section and have a substantially circular horizontal cross-section.

53. Particle of footwear as claimed in claim 1, wherein said elements are substantially H-shaped in vertical cross-section.

54. Method as claimed in claim 1, wherein the step of forming the element comprises forming elements which are of substantially circular horizontal cross-section.

55. Particle of footwear as claimed in claim 1, wherein said first casing is substantially circular in horizontal cross-section and said second casing is substantially arcuate shaped in horizontal cross-section.

56. Method claimed in claim 31, wherein the inserting of said elements into the first and second casing comprises inserting said elements into a first casing having a substantially circularly shaped horizontal cross-section and into a second casing having a substantially arcuate shaped horizontal cross-section.

57. An article of footwear, which comprises:

a vamp;

a lower support connected to said vamp; and at least one insert mounted in said lower support and which includes first and second airtight casings each having a plurality of elements positioned therein which are elastically deformable such that the biomechanics of a foot of a user are optimized wherein said deformable elements comprises a first and second battery of said deformable elements respectively located in said first and second casings, said first and second casings being interconnected by a bridging portion aligned with a flex line of the foot of a user, and said deformable elements being interconnected by integral bridging portions for permitting flexibility between the first and second casings wherein at least one of said elements of said first battery extends substantially across an entire width portion of said first casing.

58. An article of footwear as claimed in claim 57, wherein said bridging portion of said first and second casings is aligned with a flex line of the foot of the user.

59. A method of forming an insert for an article of footwear, which comprises:

forming at least one insert from a plurality of interconnected elements;

inserting said elements into first and second casings so as to be positioned in a sole portion of an article of footwear such that the biomechanics of a foot of a user wearing the article of footwear are optimized wherein the step of forming the interconnected element comprises forming a first and second of deformable elements so as to be respectively positioned in said first and second casings, the step of forming the elements comprises forming at least two batteries of said deformable elements, interconnecting said first and second casings by a bridging portion aligned with a flex line of a foot of a user; and forming at least one of said elements of said first battery so as to extend across substantially an entire width portion of said first casing.

60. The method as claimed in claim 29, wherein said bridging portion of said first and second casings are aligned with a flex line of the foot of the user.

61. An article of footwear as claimed in claim 1, wherein each of said elements are substantially H-shaped in vertical cross-section.

62. An article of footwear as claimed in claim 1, wherein each of said elements are substantially H-shaped in vertical cross-section.

63. A method as claimed in claim 59, wherein comprises forming each of said elements so as to be substantially H-shaped in vertical cross-section.

* * * * *